US005129430A

United States Patent [19]

Mitsuya

[11] Patent Number: 5,129,430

[45] Date of Patent: Jul. 14, 1992

[54] WEFT REMOVAL DEVICE WITH MEASUREMENT OF BROKEN YARN PIECE

[75] Inventor: Kinpei Mitsuya, Kariya, Japan

[73] Assignee: Kabushiki Kaisha Toyoda Jidoshokki Seisakusho, Kariya, Japan

[21] Appl. No.: 770,127

[22] Filed: Oct. 2, 1991

Related U.S. Application Data

[63] Continuation-in-part of Ser. No. 568,362, Aug. 16, 1990, abandoned.

[30] Foreign Application Priority Data

Aug. 25, 1989 [JP] Japan ..... 1-219531
Aug. 28, 1989 [JP] Japan ..... 1-222450
Aug. 28, 1989 [JP] Japan ..... 1-222451

[51] Int. Cl.[5] ..... D03D 47/34
[52] U.S. Cl. ..... 139/116.2; 139/370.2
[58] Field of Search ..... 139/116.2, 452, 370.2

[56] References Cited

U.S. PATENT DOCUMENTS 4,730,643 3/1988 Tamatani ..... 139/116.2
4,781,221 11/1988 Onishi et al. ..... 139/116.2
4,969,489 11/1990 Tanaka et al. ..... 139/116.2
4,989,644 2/1991 Tanaka et al. ..... 139/116.2

FOREIGN PATENT DOCUMENTS 62-28446 2/1987 Japan ..... 139/116.2

*Primary Examiner*—Andrew M. Falik
*Attorney, Agent, or Firm*—Brooks Haidt Haffner & Delahunty

[57] ABSTRACT

A weft processing apparatus for a jet loom comprises a first weft length measuring device installed at the far or downstream side of the warp shed through which the weft is inserted for measuring the length of a broken weft yarn piece. A weft withdrawal device for withdrawing a defective weft that has undergone abnormal insertion is provided at the entrance side of the warp shed. The length of the defective weft withdrawn by the withdrawal device is measured by a second weft length measuring device. A second weft withdrawal device may be provided at the far side of the warp shed for making it possible to measure the length of a broken weft yarn piece that might remain within the warp shed.

24 Claims, 30 Drawing Sheets

FIG. 7BII
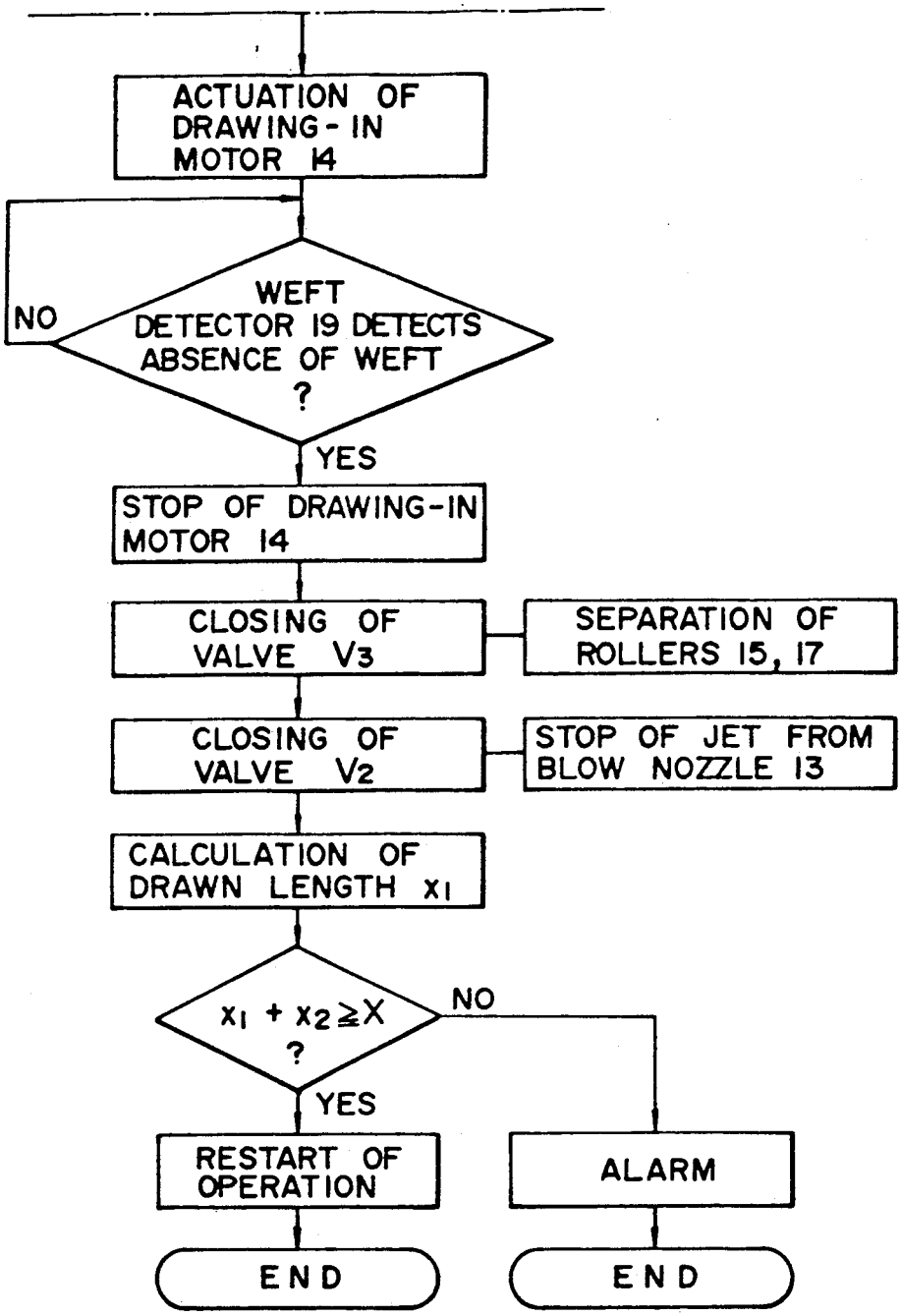
FIG. 7B
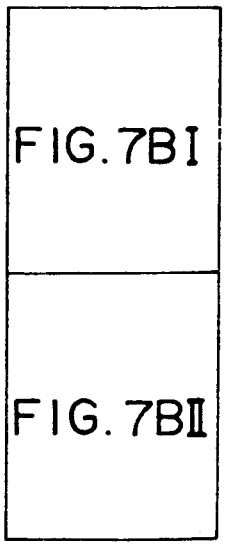

FIG. 21AII
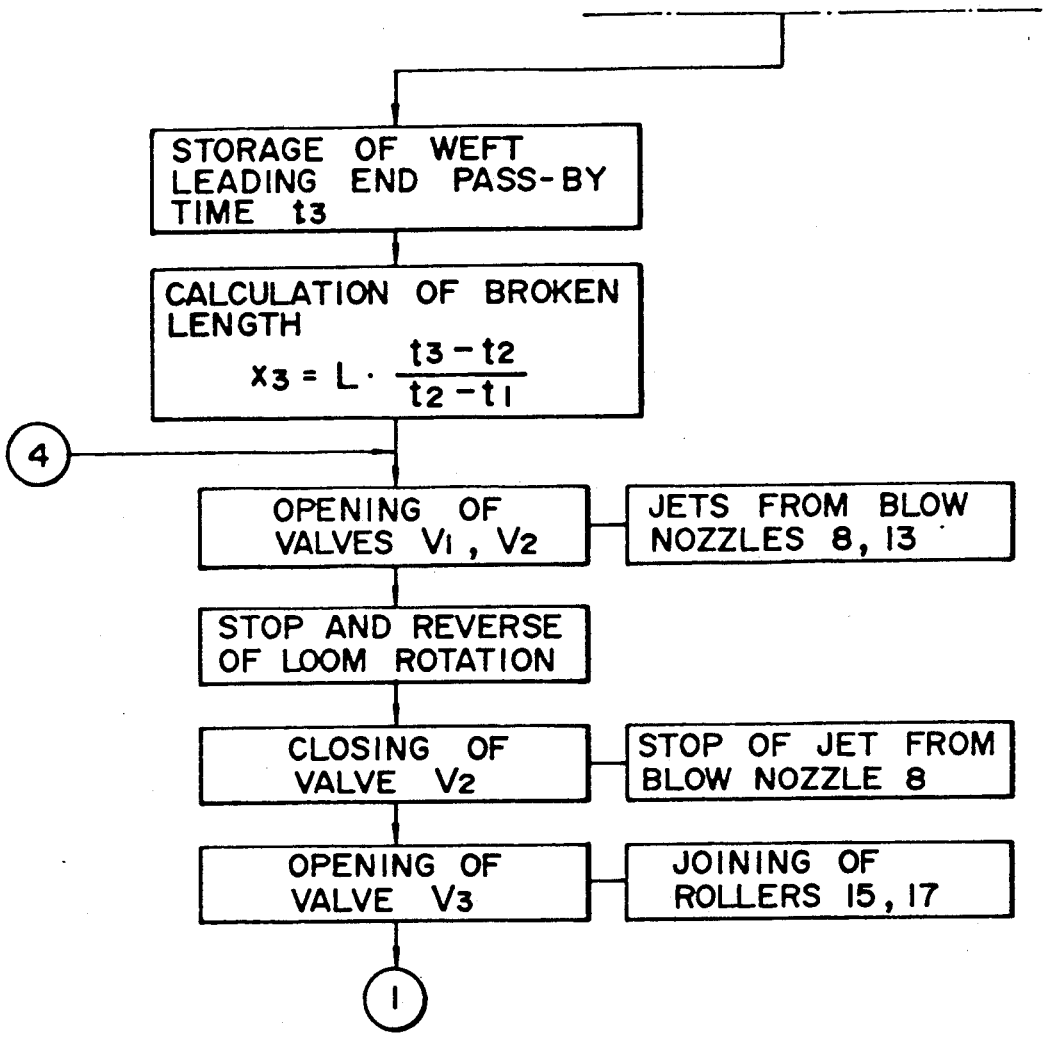

FIG. 21BII
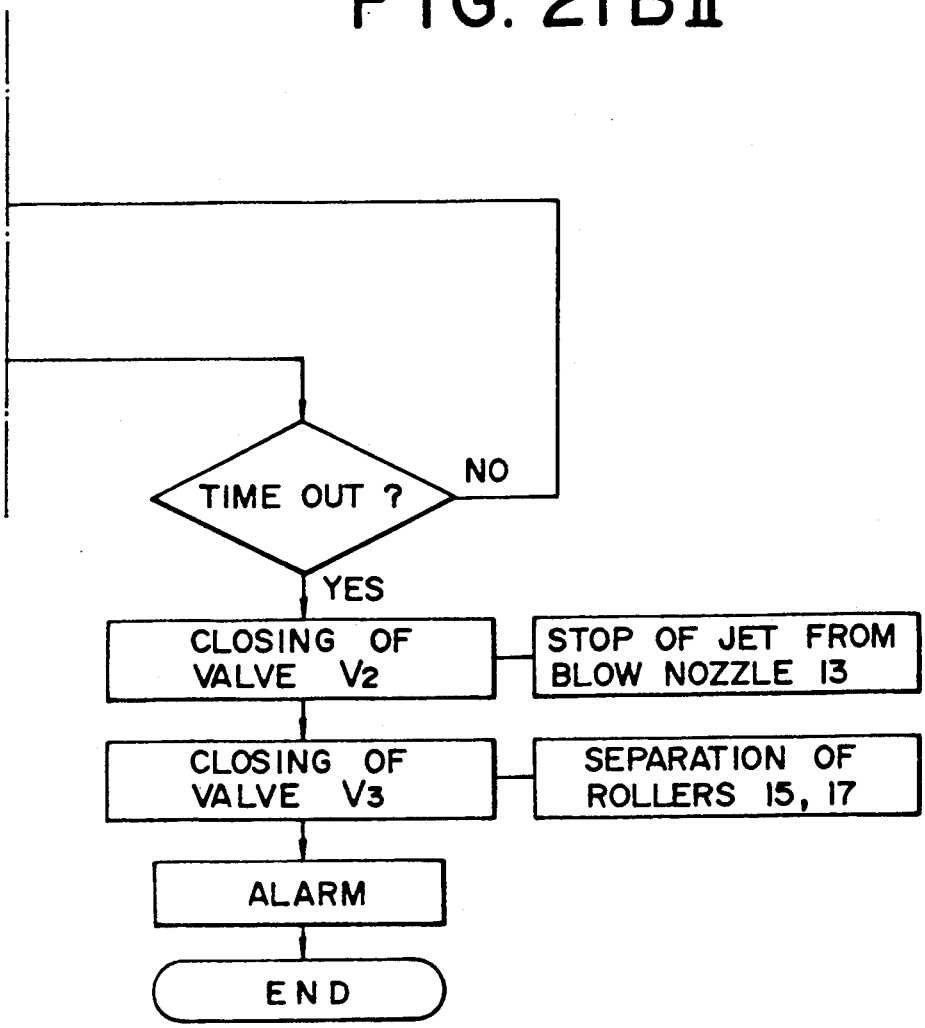
FIG. 21B
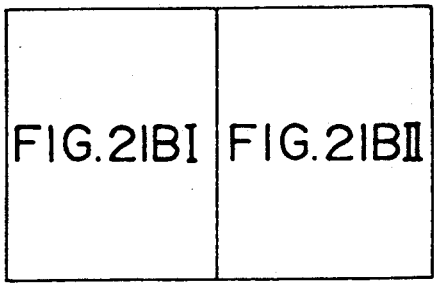

FIG. 21CII
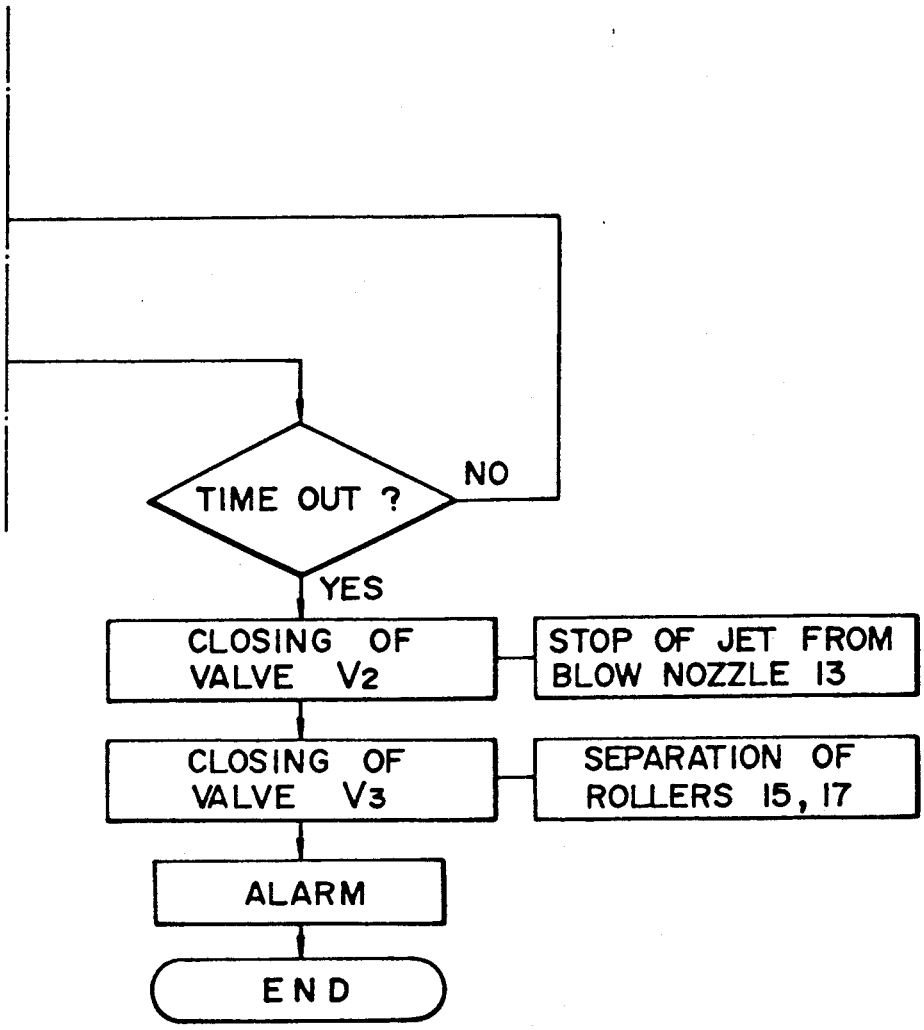
FIG. 21C
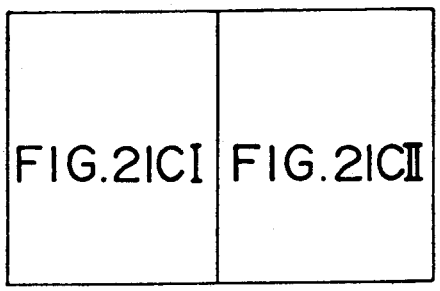

WEFT REMOVAL DEVICE WITH MEASUREMENT OF BROKEN YARN PIECE

BACKGROUND OF THE INVENTION

This application is a continuation-in-part of allowed application Ser. No. 07/568,362, filed Aug. 16, 1990, now abandoned.

FIELD OF THE INVENTION

The present invention relates generally to a jet loom of the type in which a weft to be beaten is jetted from a weft inserting main nozzle, and more particularly to a weft processing apparatus for use in the above loom to remove a defective weft which has undergone erroneous or abnormal insertion from a cloth being woven, when abnormality or error is detected in the insertion of the weft jetted from the weft inserting main nozzle.

DESCRIPTION OF THE PRIOR ART

A weft processing apparatus for taking out or removing from a cloth being woven a defective weft which has undergone abnormal or erroneous insertion in a jet loom is disclosed, for example, in JP-A-62-28446 (Japanese Laid-Open Patent Application No. 28446/1987), and in JP-A-62-215047 which latter two correspond, respectively, to U.S. Pat. Nos. 4,781,221 and 4,730,643. In the prior art weft processing techniques described in these publications, a defective weft inserted abnormally or erroneously is left connected to a succeeding weft portion without being cut off therefrom so that the defective weft can be laterally withdrawn from a cloth fell through a warp shed by making use of the succeeding weft. According to the technique proposed in JP-A-62-6938, the succeeding weft is inserted for a length corresponding to two picks, which is then followed by withdrawal of the defective weft from the weft entrance side from which the weft is inserted. However, in the apparatus disclosed in either of JP-A-62-28446 or JP-A-62-6938, if the defective weft is broken in the course of being withdrawn and a part thereof remains in the warp shed, it then becomes impossible to draw out the broken weft piece from the warp shed, giving rise to a problem.

On the other hand, with the known apparatus disclosed in JP-A-62-215047, a pair of weft drawing apparatuses are installed at both the weft entrance and far terminal sides, respectively, so that the defective weft is withdrawn by the weft withdrawal apparatus installed at the weft entrance side by taking advantage of the succeeding weft, while weft withdrawal apparatus installed at the far side of the weft at the termination point at which the leading end of the inserted weft finally arrives is adapted to draw out a broken weft piece.

In this connection, it is noted that the broken weft or yarn piece may possibly be blown off without remaining within the warp shed. In that case, there arises no necessity to operate or actuate the weft withdrawal apparatus installed at the far side of the weft. However, since the length of the blown-off yarn piece is indefinite or indeterminative, it is impossible to know whether or not the weft portion withdrawn from the weft entrance side is the whole of the defective weft resident in the warp shed. Consequently, if the defective weft should be broken in the course of being withdrawn from the entrance side, there is no estimating the length of the broken weft piece blown off, even when the withdrawn length of the defective weft connected to the succeeding weft can be determined by measurement. Thus, it is impossible to obtain information about the presence or absence of a broken weft within the warp shed, which in turn means that appropriate or correct weft processing cannot be carried out.

Further, even when the broken yarn piece remains in the warp shed, the problem remains that the presence or absence of the residual weft piece within the warp shed still cannot be determined.

SUMMARY OF THE INVENTION

Accordingly, it is a primary object of the present invention to provide a weft processing apparatus for a jet loom which is capable of performing appropriate or correct weft processing for coping with the occurrence of breakage of a defective weft.

For achieving the above object, there is proposed according to the present invention in its broadest aspect a weft processing apparatus for a jet loom which comprises a weft length measuring apparatus for measuring the length of a broken weft yarn piece broken or cut off from a weft which has been inserted in the warp shed.

According to another aspect of the invention, the weft processing apparatus may further comprise a weft withdrawal device for withdrawing an abnormal weft from the warp shed by making use of a succeeding weft, and a second weft length measuring device for measuring the length of the abnormal weft withdrawn by the weft withdrawal device.

The broken weft or yarn piece broken off from the defective weft can be determined on the basis of the difference between the times at which the leading and trailing ends of the broken yarn piece assume, respectively, the same position, and a measured weft speed which in turn may be determined on the basis of the difference between the times at which the leading end of the broken yarn piece is detected by a pair of weft detectors installed at different positions, respectively, and the known distance between the weft detectors as paired. By determining the length of the defective weft remaining within the warp shed by measuring the length of the broken yarn piece of the weft in this way, it is possible to detect the presence or absence of any residual defective weft remaining within the warp shed.

Further, by withdrawing the defective weft by making use of the succeeding weft portion and measuring the length of the defective weft, it is possible to perform in an automated manner the appropriate or proper processing for dealing with the defective weft.

In view of the abovementioned object, there is provided according to a further aspect of the invention, a weft processing apparatus for a jet loom which comprises a first weft withdrawal device disposed adjacent the far, or downstream side of the shed, for removing a broken yarn piece broken or cut off from the inserted weft by withdrawing the broken yarn piece laterally from the warp shed, a first weft length measuring device for measuring the length of the broken yarn piece withdrawn by the first weft withdrawal device, a second weft withdrawal device for removing a defective weft which has undergone abnormal weft insertion by withdrawing laterally the defective weft from the warp shed by making use of a succeeding weft portion connected to the defective weft, and a second weft length measuring device for measuring the length of the defective weft which has undergone abnormal insertion and has been withdrawn by the second weft withdrawal device.

In the case where the broken yarn piece broken or cut off from the defective weft is blown off without remaining within the warp shed, the length of the yarn piece may be determined on the basis of the difference between the detection times at which the leading and trailing ends of the yarn piece assume, respectively, the same position, and the measured yarn speed, which in turn can be determined on the basis of the difference between the detection times at which the leading end of the broken yarn piece is detected by a pair of weft detectors installed at different positions and the known distance intervening between the pair of detectors. In case the broken yarn piece remains within the warp shed, the yarn piece can be withdrawn by the weft withdrawing device installed adjacent the far side of the shed while the length of the yarn piece can be determined by measuring the distance over which the broken yarn piece is withdrawn. Further, the defective weft remaining within the warp shed and which remains connected to the succeeding weft can be withdrawn by the withdrawal device installed at the weft entrance side of the shed by making use of the succeeding weft, wherein the withdrawn length is measured by the weft length measuring device installed at the weft entrance side. Thus, it is possible to determine the presence or absence of any residual defective weft within the warp shed on the basis of the sum of the measured withdrawn length of the defective weft withdrawn from the entrance side of the shed and the measured length of the broken yarn piece taken out from the far side of the shed.

BRIEF DESCRIPTION OF THE DRAWINGS

A more detailed understanding of the present invention may be had from the following description of the presently embodiments thereof, given by way of example, and to be read and understood in conjunction with the accompanying drawings, in which.

DETAILED DESCRIPTION OF THE PREFERRED EMBODIMENTS

Figure 1:
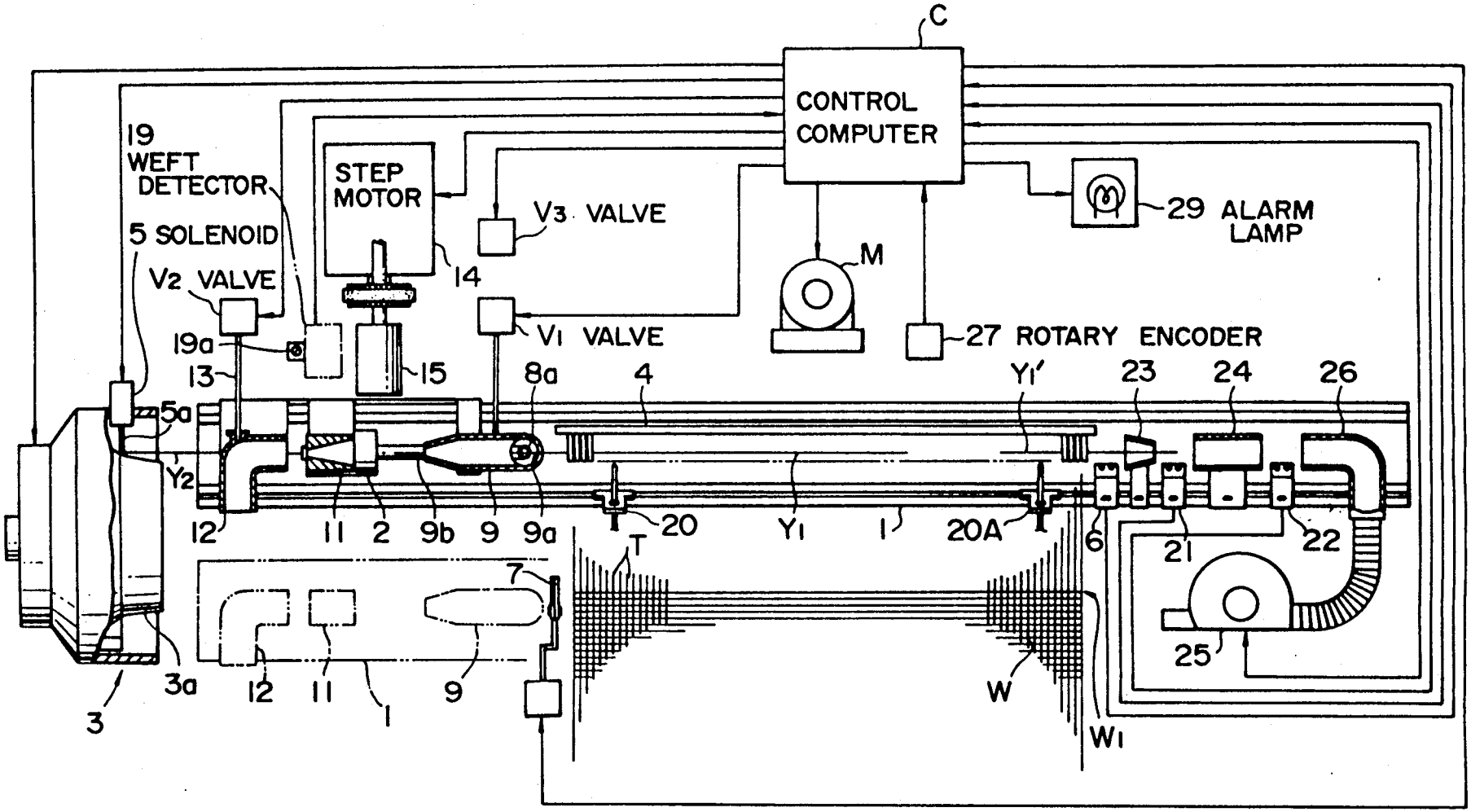
FIG. 1 is a top plan view showing schematically the structure of a jet loom around a slay, which loom is equipped with a weft processing apparatus according to an exemplary embodiment of the present invention.

Now, referring to the drawings and more particularly to FIGS. 1 to 7, a first exemplary or preferred embodiment of the present invention will be described in detail.

As shown in FIG. 1, a weft is supplied to a weft inserting main nozzle 2 which is mounted on a slay 1 at one end thereof. The supplied weft has a length measured by a winding type weft length measuring and storing apparatus 3, and it is inserted into a weft insertion passage 4*a* formed in a reed 4, itself mounted upstanding on the slay 1 (refer to FIGS. 2 to 5). The weft is inserted under the action of an air jet stream ejected from the weft inserting main nozzle 2 in synchronism with the intended weft insertion timing. Drawing or extraction of the weft from a weft winding surface 3a on which the length of weft is wound is controlled by a retaining pin 5a which is driven by a solenoid 5 so as to be moved toward and away from the weft winding surface 3a.

A leading end portion of the weft jetted from the weft inserting main nozzle 2 and inserted in the weft insertion passage 4a flies or runs therethrough smoothly under the action of relaying jets of a fluid such as air jetted from a plurality of auxiliary weft inserting nozzles 20, 20A (only two auxiliary nozzles are shown) which are disposed along the weft insertion passage 4a. The leading end of the inserted weft is detected by a weft detector 6 which is installed at a predetermined terminator point for reception of the weft leading end. This position is located beyond the farthest downstream auxiliary weft inserting nozzle 20A for checking whether or not the weft leading end has reached the predetermined downstream end position mentioned above within a preset angular range of rotation of the loom crank shaft. The weft presence/absence detection information outputted from the weft detector 6 is inputted to a control computer C, which then selects either continued operation or stoppage of a loom driving motor M on the basis of the weft presence/absence information. When the weft insertion has been performed normally, the weft as inserted is beaten against a cloth fell $W_1$ of woven cloth W by the modified reed 4 to be woven into the cloth W. The beaten weft is cut by an electromagnetic cutter 7 disposed at a position near the weft inserting main nozzle 2, whereupon the weaving operation is successively repeated.

On the other hand, unless the weft has reached the predetermined position at which the weft detector 6 is installed, the weft presence/absence detection information indicating a weft insertion error, i.e. failure in the weft insertion, is produced by the detector 6 to be supplied to the control computer C, which responds thereto by commanding the stoppage of the loom driving motor M. After the weft insertion error or failure signal is detected, the loom makes about one complete rotation under inertia before it stops. More specifically, when the weft insertion failure detection information signal is issued during the forward movement of the slay 1 in the direction from the most retracted position thereof toward the woven cloth W, the slay 1 moves reciprocatively after the defective weft $Y_1$ has been beaten into the woven fabric and then stops at a position immediately preceeding the beating position as indicated by a double-dot broken line in FIG. 1. At the same time, upon generation of the weft insertion failure detection information signal, the electromagnetic cutter 7 is set to the inoperative state, so that the defective weft $Y_1$ woven into the cloth W at the cloth fell $W_1$ is maintained in the state connected to the weft inserting main nozzle 2. Parenthetically, prevention of the weft from being cut may be realized by providing other suitable means for moving the weft outside of the operating region of the weft cutting device.

Figure 3:
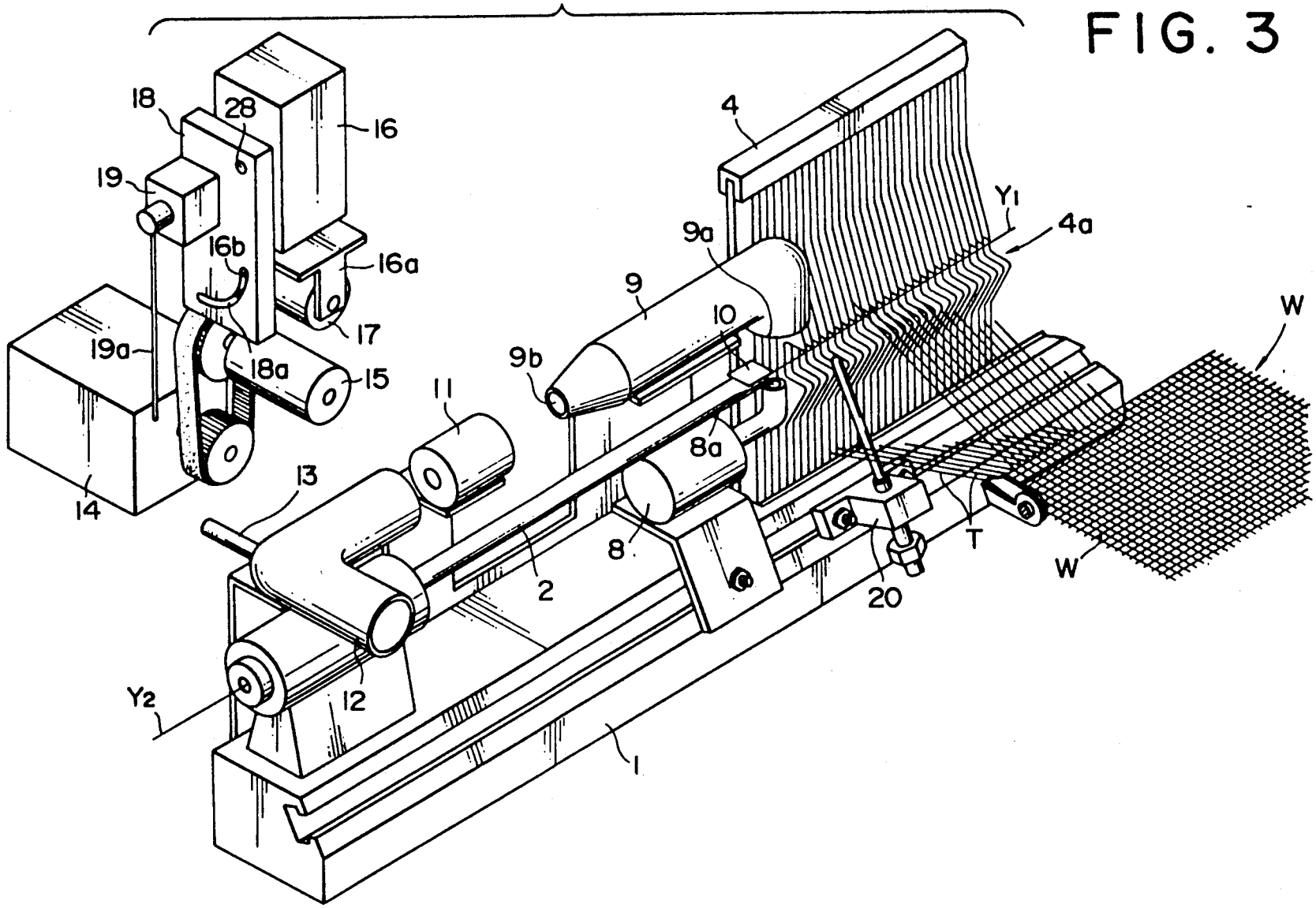
FIG. 3 is a perspective view showing the weft withdrawal device installed adjacent the shed entrance for weft insertion.

Referring to FIG. 3, mounted immediately below the weft inserting main nozzle 2 is a blow nozzle device 8 connected to a pressurized air supply source (not shown) and having a jet orifice 8a oriented in the direction which intersects the jet path of the weft inserting main nozzle 2. Mounted immediately above the weft inserting main nozzle 2 is a weft removal duct 9 having an inlet 9a which is located at a position opposite the jet orifice 8a of the blow nozzle 8 so that the jet path of the weft inserting main nozzle 2 is positioned between the inlet 9a and the orifice 8a. A stationary cutter blade 10 is interposed between the inlet 9a and the jet orifice 8a of the blow nozzle 8. Installed downstream of an outlet or exit 9b of the weft removal duct 9 are an air guide 11 and a suction pipe 12 which are movable integrally with the slay 1. The exit and inlet of the air guide 11 and the inlet of the suction pipe 12 are positioned on and along a discharge path extending from the outlet 9b of the weft removal duct 9. The outlet portion of the suction pipe 12 is bent toward a dust box (not shown) which is disposed in front of the region where the slay 1 is caused to reciprocate. Connected to the bend portion of the suction pipe 12 is a blow nozzle 13 which is connected to the pressurized air supply source mentioned above (not shown) and has an open end portion oriented in the direction toward the exit of the suction pipe 12.

A step motor 14 is installed at the rear of the reciprocation region of slay 1. Disposed immediately above the step motor 14 is a driving roller 15 which is operatively coupled to the step motor 14. An air cylinder 16 is installed immediately above the driving roller 15 in a vertically upstanding disposition, and a supporting frame 16a is fixedly connected to the lower end of a driving rod (not shown) of the air cylinder 16 for supporting rotatably thereon a driven roller 17 at a position opposing the driving roller 15. The driven roller 17 can be pressed against the driving roller 15 upon an extending stroke operation of the air cylinder 16.

A supporting plate 18 is suspended downwardly and rotatably by a supporting stud 28 on a side wall of the air cylinder 16. There is formed in a lower portion of the supporting plate 18 an arcuate guide slot 18a in which a guide pin 16b mounted on the supporting frame 16a and extending laterally therefrom is slidably engaged. Further mounted on the supporting plate 18 is a weft detector 19 having a detecting arm 19a which extends vertically downwardly.

The driving roller 15 and the driven roller 17 are so positioned as to oppose each other across a gap formed between the weft removal duct 9 and the air guide 11 while the detection arm 19a is so positioned that the free end portion thereof can traverse or sweep the space defined between the air guide 11 and the suction pipe 12, when the slay 1 is at the most retracted position.

Figure 2:
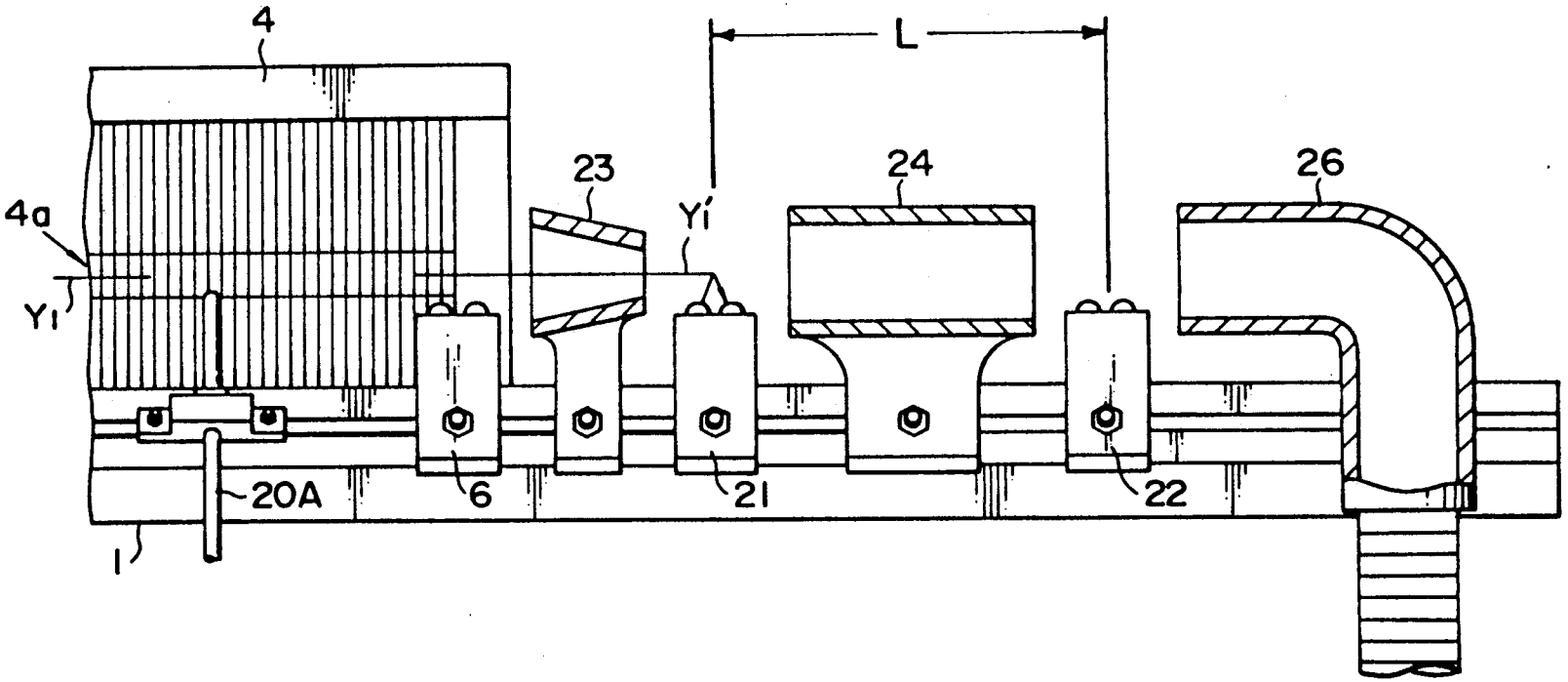
FIG. 2 is an enlarged fragmentary front view showing a main portion of the weft processing apparatus shown in FIG. 1 in the state that the leading end of a broken yarn piece of a defective weft which has undergone erroneous insertion is about to reach a first length measuring sensor on the far side of the warp shed.

Referring to FIGS. 1 and 2, fixedly mounted on the slay 1 at positions located close to the weft downstream terminating position beyond the weft detector 6 are a pair of length measuring sensors 21 and 22 of a photoelectric type with a predetermined distance L therebetween, which distance is previously loaded and stored in the control computer C. An air flow converging tube 23 is mounted fixedly on the slay 1 between the weft detector 6 and the length measuring sensor 21. Additionally, an air guide 24 is fixedly mounted on the slay 1 between the length measuring sensors 21 and 22. The air flow converging tube 23 and the air guide 24 have respective center axes which are aligned with a projection of the weft inserting passage 4a, whereby detection regions of both length measuring sensors 21 and 22 are defined on and along the extended axis of the weft inserting passage 4a. Installed beyond the length measuring sensor 22 is a suction pipe 26 which is connected to a blower 25 so as to move in unison with the slay 1 together with the air flow converging tube 23 and the air guide 24.

The blow nozzle device 8, the blow nozzle 13 and the air cylinder 16 are connected to a pressurized air supply tank (not shown) through electromagnetic or solenoid valves $V_1$, $V_2$ and $V_3$, respectively. These electromagnetic valves $V_1$, $V_2$ and $V_3$ as well as the blower 25 and the step motor 14 are placed under the control of the computer C. In other words, the control computer C controls the electromagnetic valves $V_1$, $V_2$ and $V_3$, the blower 25 and the step motor 14 correspondingly on the basis of the detection signals outputted from the weft detectors 6, 19 and the length measuring sensors 21, 22.

Figure 7A:
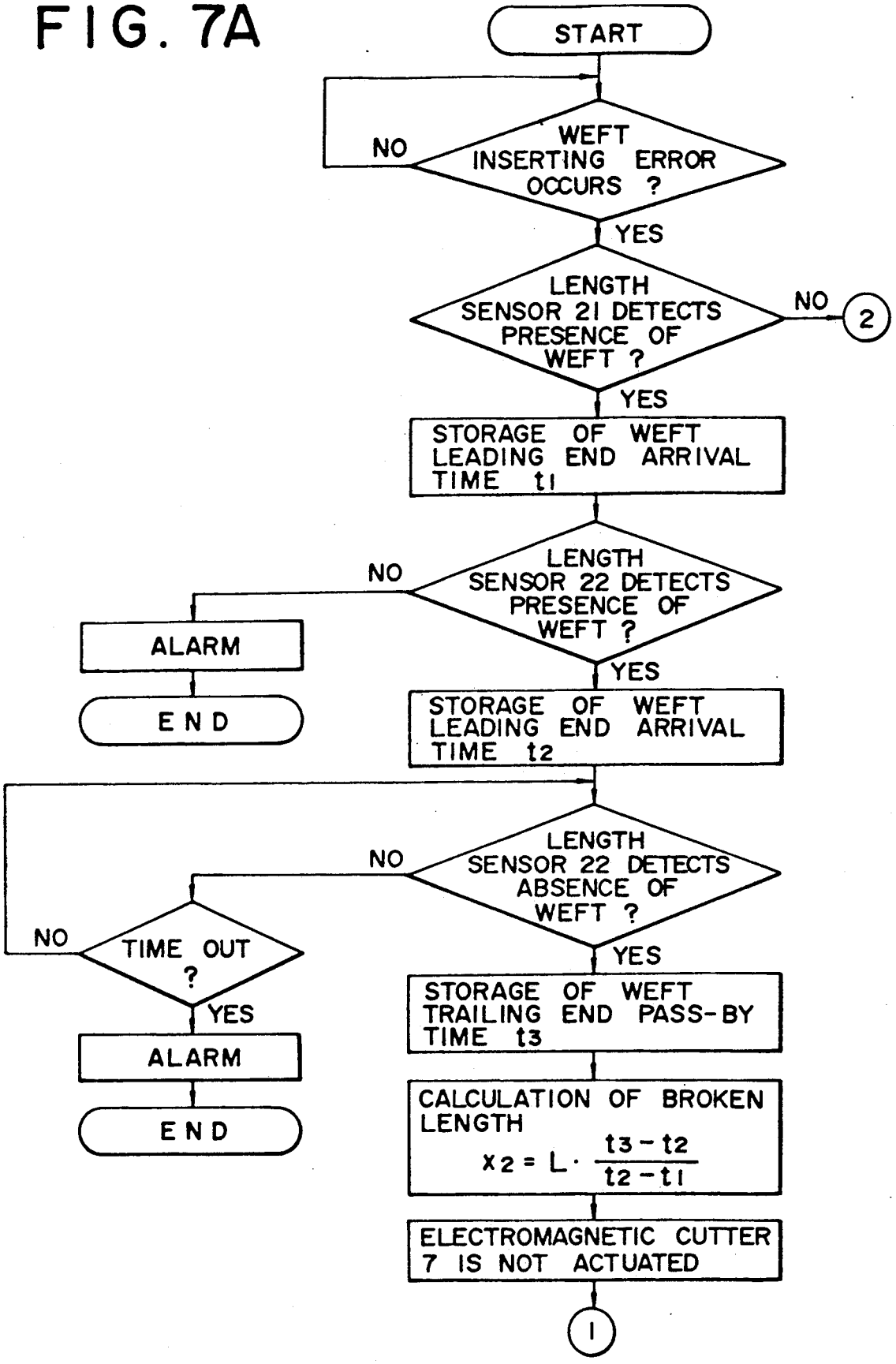
FIGS. 7A, 7BI and 7BII are flow charts for illustrating a weft processing program.
Figure 7B:
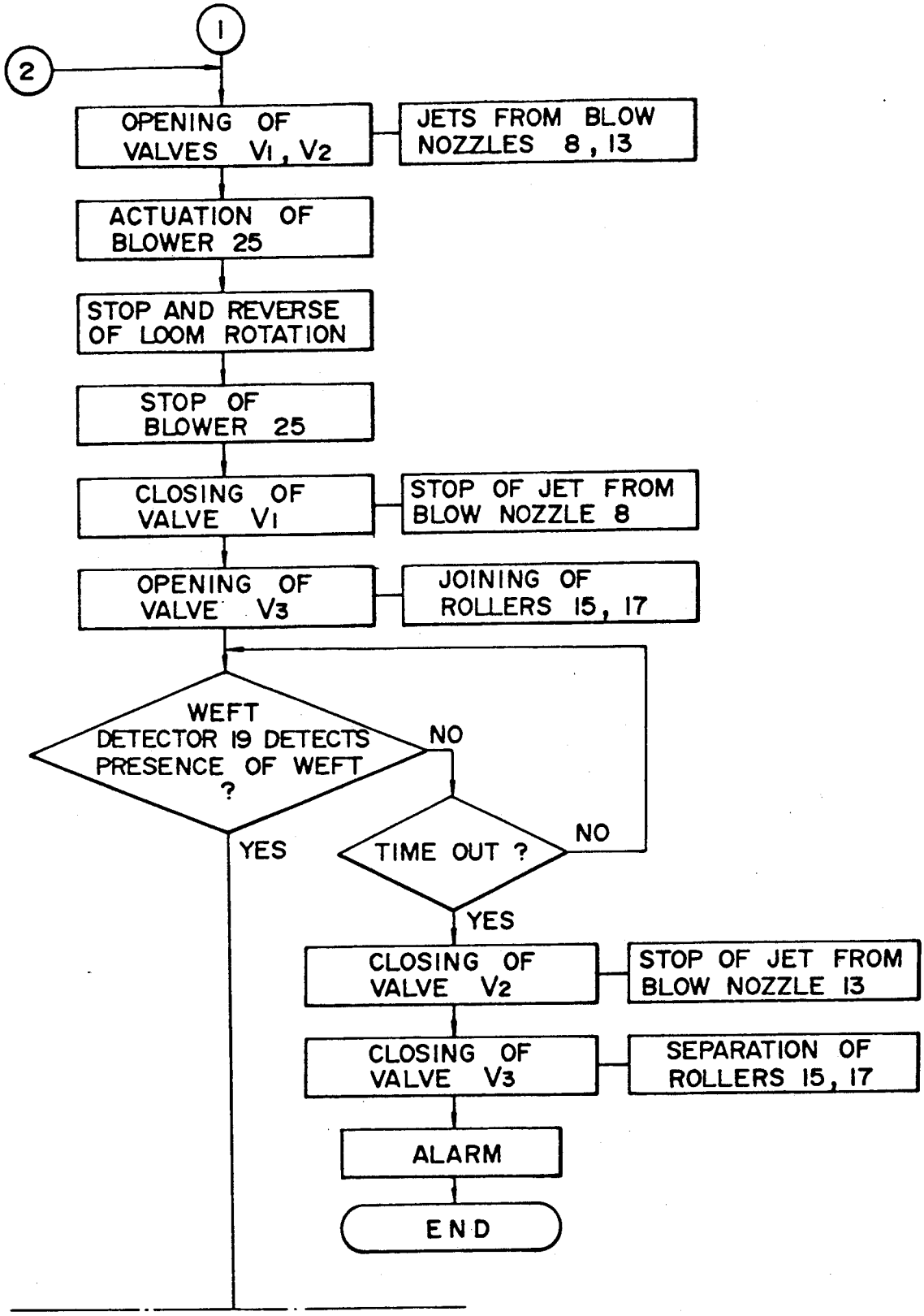

Upon occurrence of a weft insertion error or failure, the control computer C executes a weft processing program illustrated in the form of flow charts in FIGS. 7A and 7B. Referring to these figures, upon occurrence of failure in the insertion of a weft such that the inserted weft does not reach the position at which the weft detector 6 is installed, the loom control computer C responds to the weft insertion error or failure detection signal outputted from the weft detector 6 to thereby stop the operations of the electromagnetic cutter 7 and the loom driving motor M and at the same time command the opening of the electromagnetic valves $V_1$ and $V_2$, whereby pressurized air is supplied to the blow nozzles 8 and 13. The result is that a weft insertion preventing diverting air flow commences between the blow nozzle 8 and the weft removal duct 9, the air flow traversing the jet region defined immediately downstream of the weft inserting main nozzle 2, while a suction air flow is produced at the inlet side of the suction pipe 12.

These air flows continue to be produced accompanied by the inoperative state of the electromagnetic cutter 7 until the slay 1 has been stopped at the position indicated by the phantom in FIG. 1. Consequently, the defective weft $Y_1$ is beaten to the cloth fell $W_1$, while a weft portion $Y_2$ following the defective weft $Y_1$ is withdrawn from the weft length measuring and storing apparatus 3 by the weft insertion preventing air flow jetted from the blow nozzle 8 during rotation of the loom under inertia. The succeeding weft $Y_2$ as it is withdrawn is thus introduced forcibly into the weft removal duct 9 through the inlet 9*a* thereof. The weft $Y_2$ is then caused to move into the suction pipe 12 from the exit 9*b* of the suction duct 9 through the air guide 11 to be subsequently blown out toward the dust box mentioned above under the jet action of the blow nozzle 13. As a consequence, the portion of the weft $Y_2$ located between the weft introducing duct 9 and the suction pipe 12 is subjected to a tension of corresponding magnitude.

The weft $Y_1$ might also be broken, as by a jet of high pressure air from the main nozzle 2 acting on a weft which has been untwisted and thus weakened by the gentle but constant blowing of standby air on its leading end while the loom is stopped for an inordinately long time; or by the impact of the high pressure nozzle air on a weft which has been damaged by an unusual engaging shock of the weft retaining pin 5*a*; or by the nozzle air acting on a weft having uneven diameter and therefore a weak point at the location of impact of the nozzle air. In any event, when the weft $Y_1$ is broken, the broken weft piece $Y'_1$ is detected by the length measuring sensor 21. In that case, the control computer C detects breakage of the weft $Y_1$ on the basis of the detection signals outputted from the length measuring sensors 21 and 22 before the weft insertion preventing operation can be performed within the period from the weft insertion failure detection to stoppage of the loom. Referring to FIGS. 1, 2, 4 and 5, when the broken piece $Y'_1$ of the yarn $Y_1$ is blown off toward the suction pipe 26, the control computer obtains and stores the instantaneous times at which the leading and trailing ends of the broken yarn piece $Y'_1$ are detected, and the angular information from the rotary encoder 27 for detecting the rotational angle of the loom.

Figure 4:
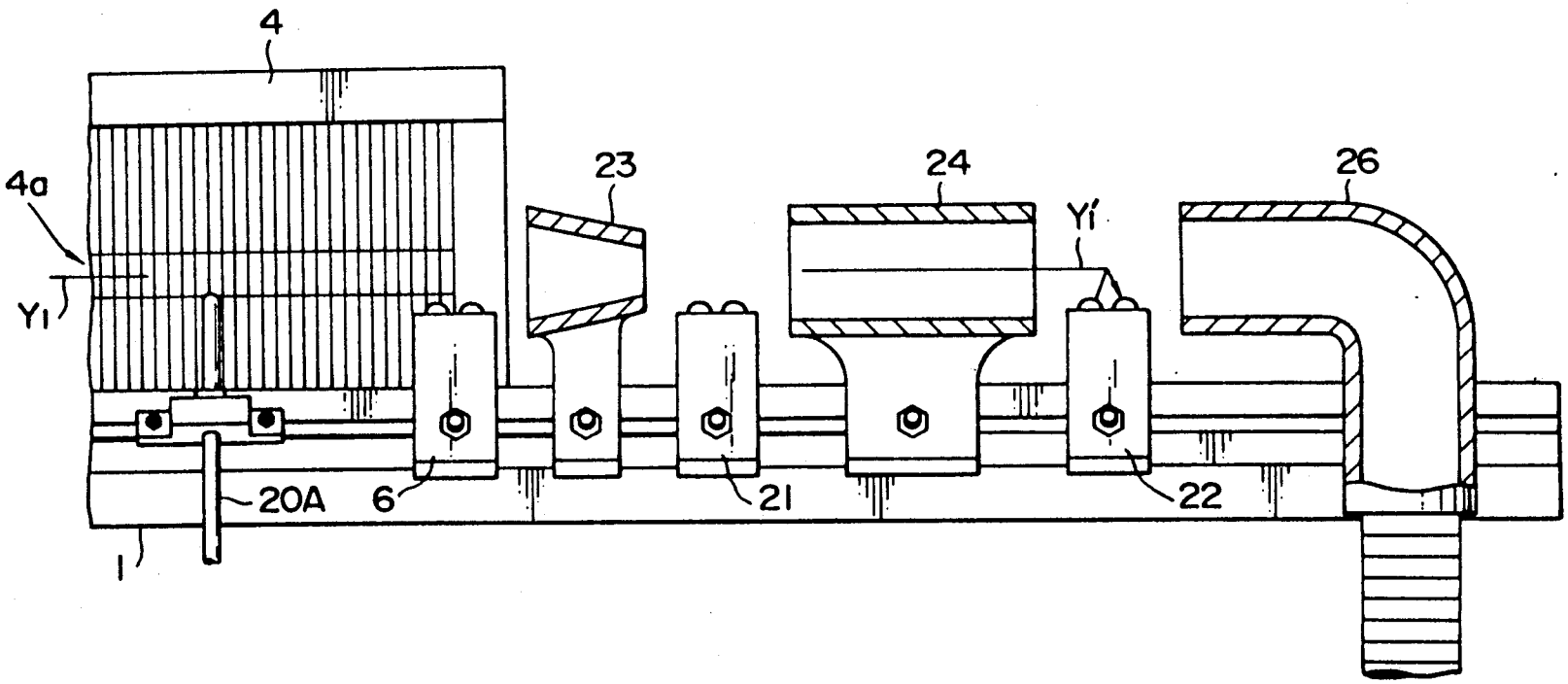
FIG. 4 is a view similar to FIG. 2 illustrating the state in which the leading end of the broken yarn piece of the defective weft is about to reach a second length measuring sensor.
Figure 5:
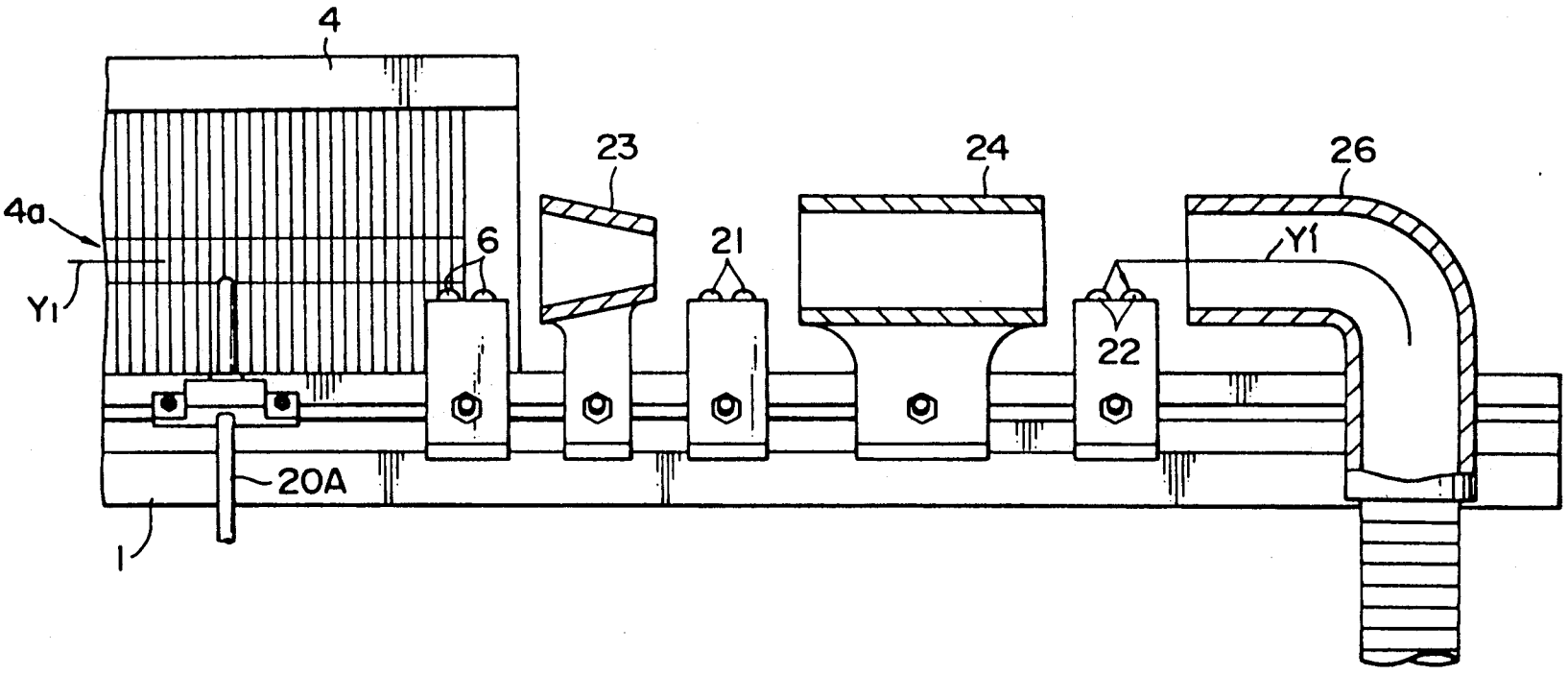
FIG. 5 is a view similar to FIG. 2 illustrating the state in which the leading end of the broken yarn piece of the defective weft is about to pass by the second length measuring device.

More specifically, the control computer C first stores a weft leading end arrival time $t_1$ at which the leading end of the broken yarn piece $Y'_1$ reaches the detection region of the length measuring sensor 21, as shown in FIG. 2, and then a weft leading end arrival time $t_2$ at which the leading end of the broken yarn piece $Y'_1$ reaches the detection region of the length measuring sensor 22 as is illustrated in FIG. 4. When the trailing end of the broken yarn piece $Y'_1$ has just passed by the detection region of the length measuring sensor 22, the control computer C obtains and stores therein a weft trailing end pass-by time $t_3$. Subsequently, the control computer C performs an arithmetic operation on the basis of the times $t_1$ $t_2$ and the pass-by time $t_3$ as stored and the preset distance L mentioned hereinbefore in accordance with the following expression:

$$x_2 = L(t_3 - t_2)/(t_2 - t_1)$$

where the term $L/(t_2 - t_1)$ represents the velocity of the broken yarn piece $Y'_1$ and $(t_3 - t_2)$ represents the time taken for the yarn piece $Y'_1$ to traverse the fixed point defined by the length measuring sensor 22. Thus, the length of the broken yarn piece $Y'_1$ is equal to $x_2$.

Figure 6:
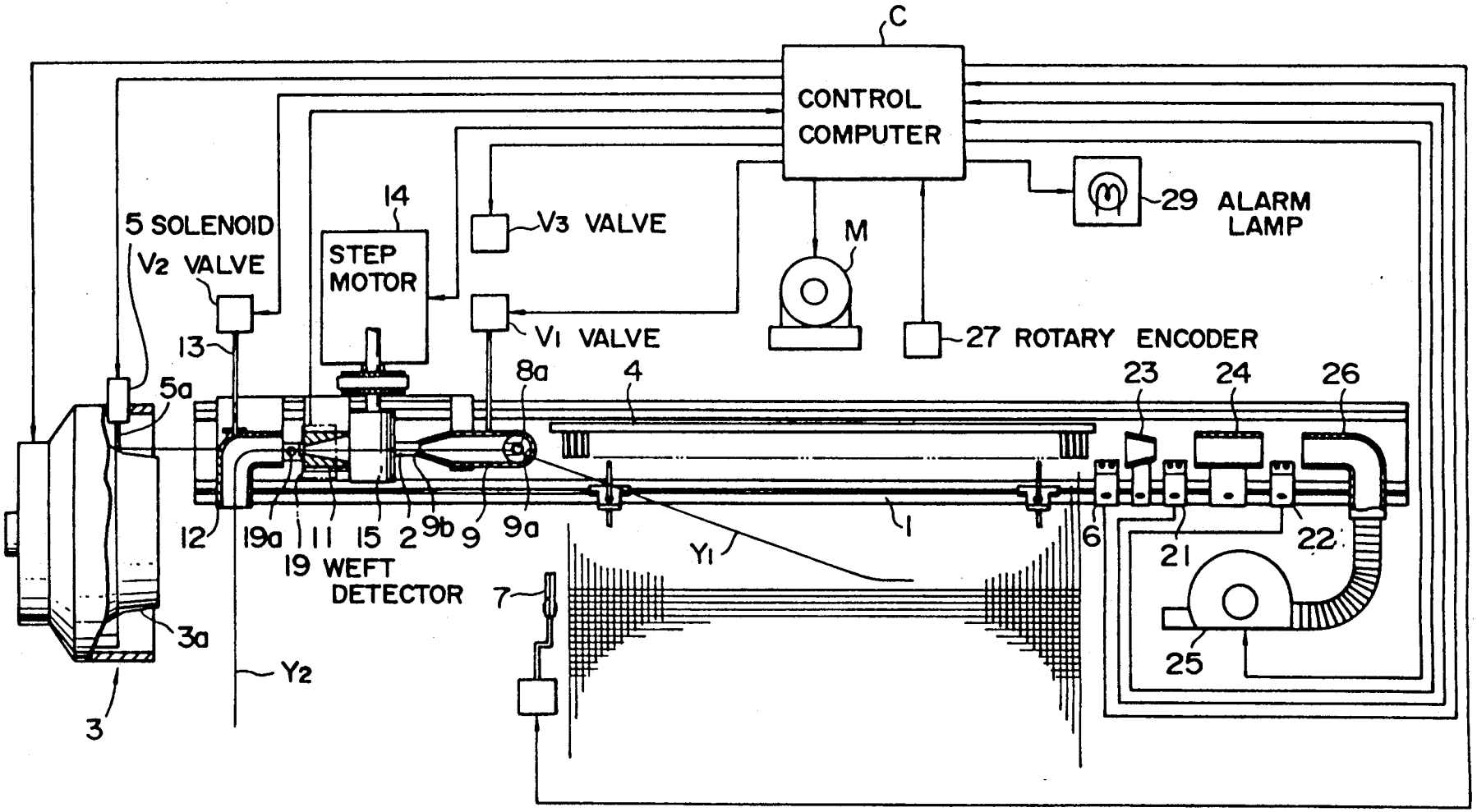
FIG. 6 is a schematic top plan view of the loom of FIG. 1 showing the state in which a defective weft is separated from a cloth fell under the action of a pair of withdrawal rollers.

After the stoppage of the loom, the loom control computer C commands the rotation of the loom in the reverse direction for a predetermined angular distance on the basis of the detection signal obtained from the rotary encoder 27, whereby the slay 1 is moved to the most retracted position as shown in FIG. 6. As a result, the warps T are set to the opened state (i.e. the state forming a warp shed), whereby the defective weft $Y_1$ is released from between the upper and lower layers of the warps T. At the same time, the succeeding weft portion $Y_2$ located between the weft removal duct 9 and the air guide 11 is displaced to a grip region defined between the driving roller 15 and the driven roller 17, while another portion of the succeeding weft $Y_2$ located between the air guide 11 and the suction pipe 12 is displaced to the region swept by the detecting arm 19*a*. After the reverse rotation of the loom, the electromagnetic valve $V_1$ is closed, whereby the weft insertion preventing air flow disappears. In this state, the control computer C commands the opening of the electromagnetic valve $V_3$ to thereby cause the driven roller 17 to bear against the driving roller 15 under pressure.

As the driven roller 17 is moved downwardly, the supporting plate 18 is caused to rotate around the supporting pin 28 through cooperation of the guide pin 16*b* and the guide slot 18*a* which engage slidably with each other. As a result, the detecting arm 19*a* performs a sweeping rotation and traverses the space between the air guide 11 and the suction pipe 12. At that time, when the succeeding weft $Y_2$ is not between the pair of rollers 15, 17 and the suction pipe 12, the detecting arm 19*a* moves in unison with the weft detector 19 which thus produces no detection signal indicating the presence of the weft. Unless the weft presence signal is obtained within a predetermined period, the control computer C decides that an abnormality has occurred in the weft processing and commands the flashing of an alarm lamp 29 while commanding the closing of the electromagnetic valves $V_2$ and $V_3$. As a consequence, the suction air flow mentioned previously is stopped with the air cylinder 16 resuming the retracted position shown in FIG. 3.

On the other hand, when the succeeding weft portion $Y_2$ is present between the pair of rollers 15, 17 and the suction pipe 12, the detecting arm 19*a* engages the weft portion $Y_2$ which is in the tensioned state to rotate relative to the body of the weft detector 19, as a result of which an ON signal indicating the presence of the weft is generated by the weft detector 19. In response to this weft presence signal, the control computer C commands actuation of the step motor 14. Thus, the driving roller 15 and the driven roller 17 are caused to rotate in the state in which the weft $Y_2$ is gripped therebetween. As the rollers 15 and 17 rotate, the weft $Y_2$ is drawn toward the suction pipe 12 under tension to be subsequently cut by the stationary blade 10 and separated from the weft inserting main nozzle 2, while the defective weft $Y_1$ on the cloth fell $W_1$ is loosened therefrom.

The defective weft $Y_1$ loosened from the cloth fell $W_1$ is sucked into the suction pipe 12 while being gripped between the paired rollers 15 and 17. So long as the defective weft $Y_1$ is held by the pair of rollers 15 and 17, the weft detector 19 continues to supply the weft presence signal to the control computer C. Upon disappearance of this weft presence detection signal, the control computer C commands the stoppage of the step motor 14 and simultaneously the closing of the electromagnetic valves $V_3$ and $V_2$. Consequently, the rollers 15 and 17 are moved away from each other, while the blow nozzle 13 stops jetting. Subsequently, the control computer C arithmetically determines the length $x_1$ of the defective weft $Y_1$ withdrawn from the warp shed on the basis of the number of pulses supplied to the step motor 14 for the actuation thereof over a period during which the weft presence detection signal is fed to the computer C from the weft detector 19.

The control computer C then arithmetically determines a sum of the length $x_1$ of the yarn withdrawn and the length $x_2$ of the broken yarn piece $Y'_1$. When the value of the sum $(x_1+x_2)$ is not smaller than a value X corresponding to a preset length for weft insertion, the control computer C commands the restart of loom operation. On the other hand, when $x_1+x_2<X$, the alarm lamp 29 is energized. The situation for which $x_1+x_2<X$ applies may occur, for example, when the defective weft $Y_1$ is broken or cut off (e.g. blown off) in the course of being withdrawn. If the loom operation is restarted at such time, a portion of the defective weft $Y_1$ will be woven into the cloth W. However, since the presence or absence of the residual defective weft $Y_1$ within the warp shed can be detected by measuring the length $x_1$ of the broken yarn piece $Y'_1$ at the end of the weft insertion, there is no possibility that the loom operation might be restarted with a portion of the defective weft $Y_1$ being left in the warp shed.

In this connection, it should be mentioned that in the case of the instant embodiment of the invention, the alarm is generated unless the length measuring sensor 22 detects the presence of the weft notwithstanding the detection of the weft presence by the length measuring sensor 21. This is because such situation may be encountered when the broken yarn piece $Y'_1$ of the defective weft $Y_1$ remains within the warp shed. In that case, the residual broken yarn piece $Y'_1$ will have to be manually removed by the operator.

Figure 8:
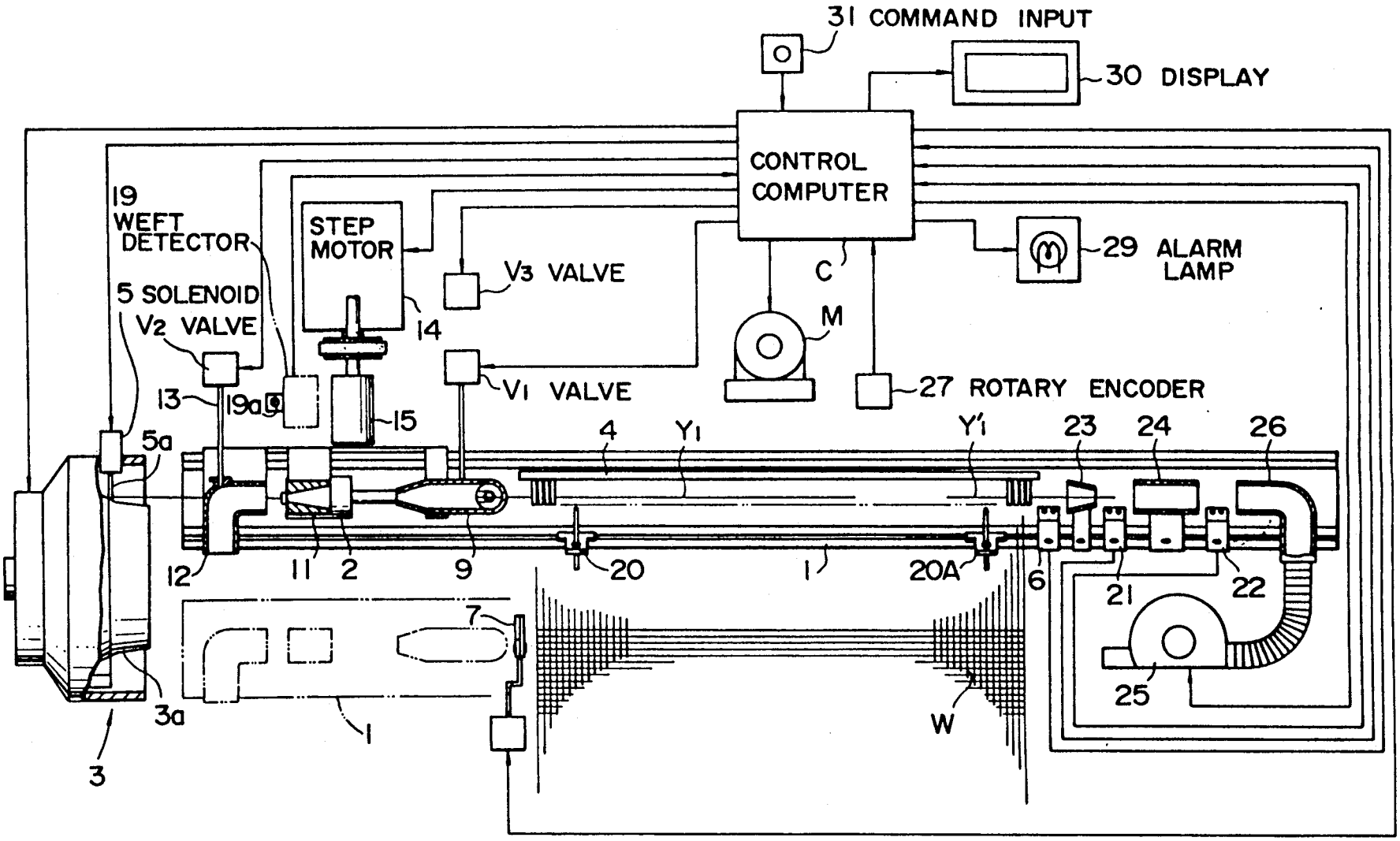
FIGS. 8 and 9 are schematic top plan views showing different modifications of the weft processing apparatus shown in FIG. 1.

In a modification of the embodiment described above, a display device 30 for displaying the length $x_2$ of the broken yarn piece $Y'_1$ may be provided as shown in FIG. 8. In that case, a command button 31 may be connected to the control computer C for actuating the weft drawing device composed of the blow nozzles 8, 13, the step motor 14, the pair of rollers 15, 17, the air cylinder 16 and the weft detector 19 to allow the defective weft $Y_1$ to be withdrawn in response to start manipulation of the command button 31. The position of the leading end of the defective weft $Y_1$ within the warp shed can be easily recognized visually by the operator, and thus the length of the yarn piece $Y'_1$ can be determined on the basis of the leading end position of the defective weft. When the length thus determined is approximately equal to the measured length $s_2$, it can be concluded that no broken yarn $Y'_1$ remains within the warp shed. Then, the command button 31 may be manipulated to restart the loom operation.

Figure 9:
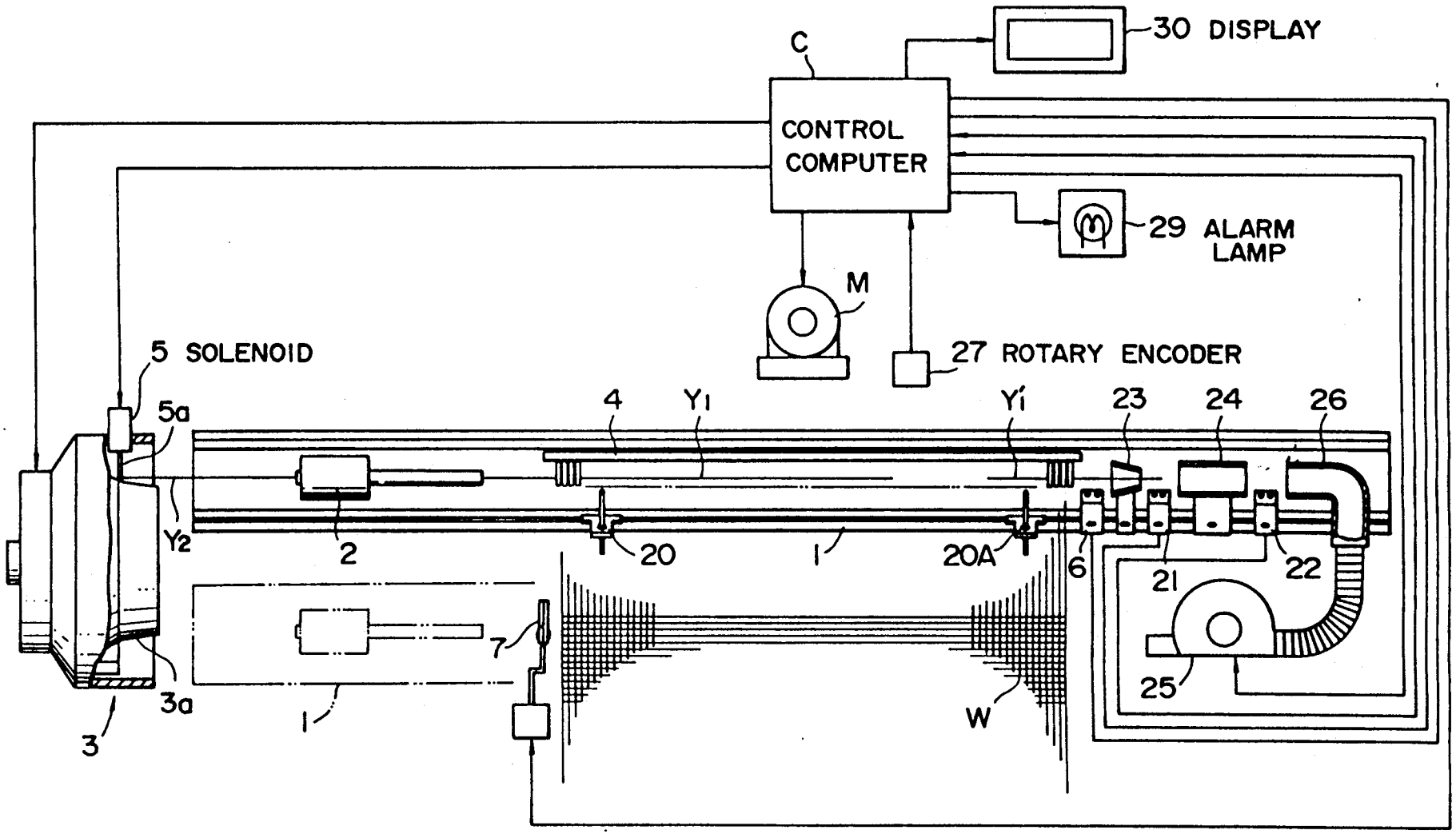
Figure 10:
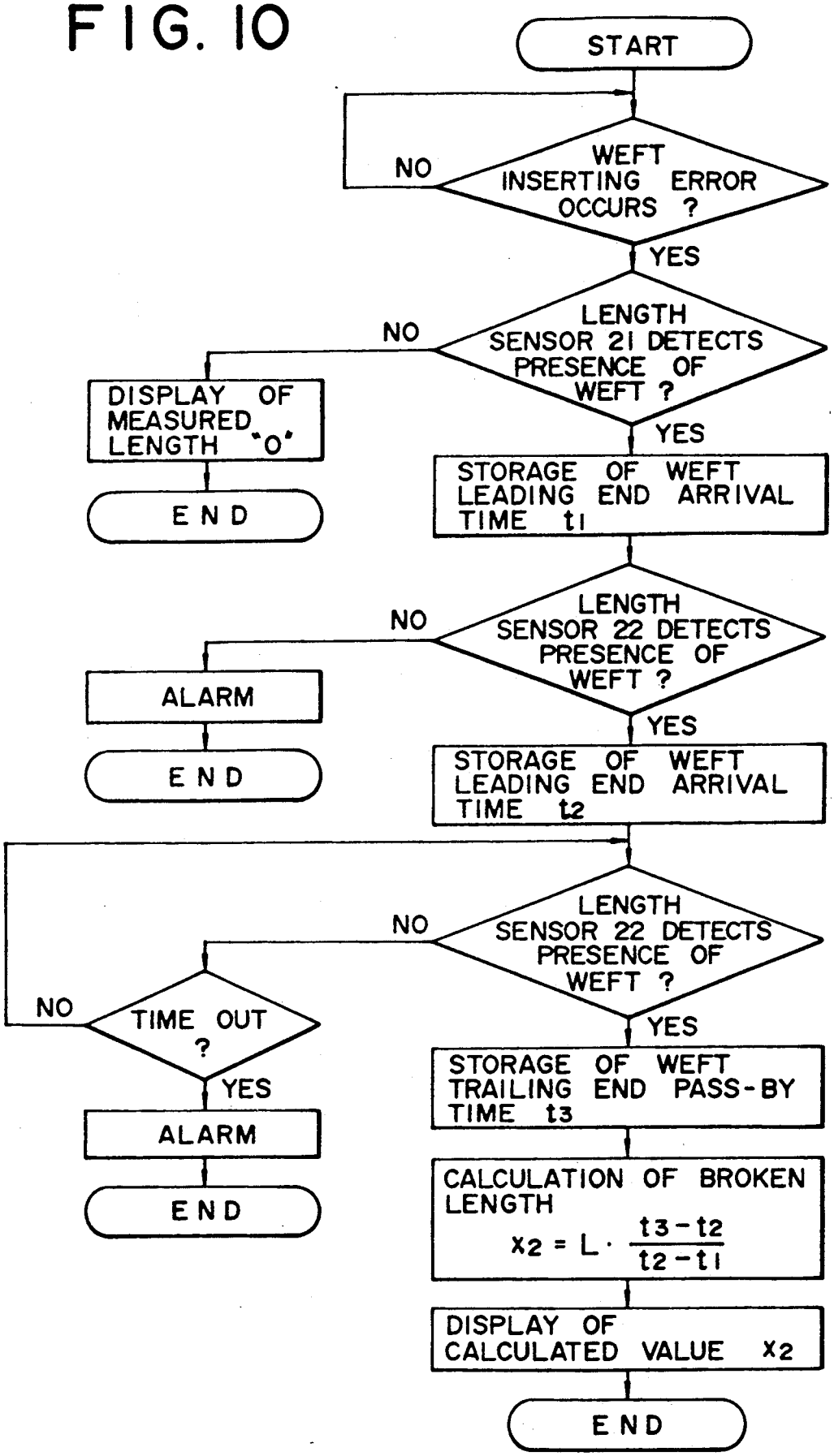
FIG. 10 shows in a flow chart a control program for length measurement and display in the modified apparatuses shown in FIGS. 8 and 9.

FIG. 9 shows a version of the embodiment shown in FIG. 8 which differs from the latter in that the withdrawal device or mechanism is omitted from the weft processing apparatus in which case the defective weft $Y_1$ remaining in the warp shed must be removed manually by the operator. However, the information that the defective weft $Y_1$ remains within the warp shed can still be obtained by measuring the length of the broken yarn piece $Y_1$ and detecting the leading end position of the defective weft $Y_1$ as in the case of the embodiment shown in FIG. 8. FIG. 10 shows in a flow chart the program executed for measuring and displaying the length of the broken yarn piece Y' in the weft processing apparatuses shown in FIGS. 8 and 9.

Figure 11:
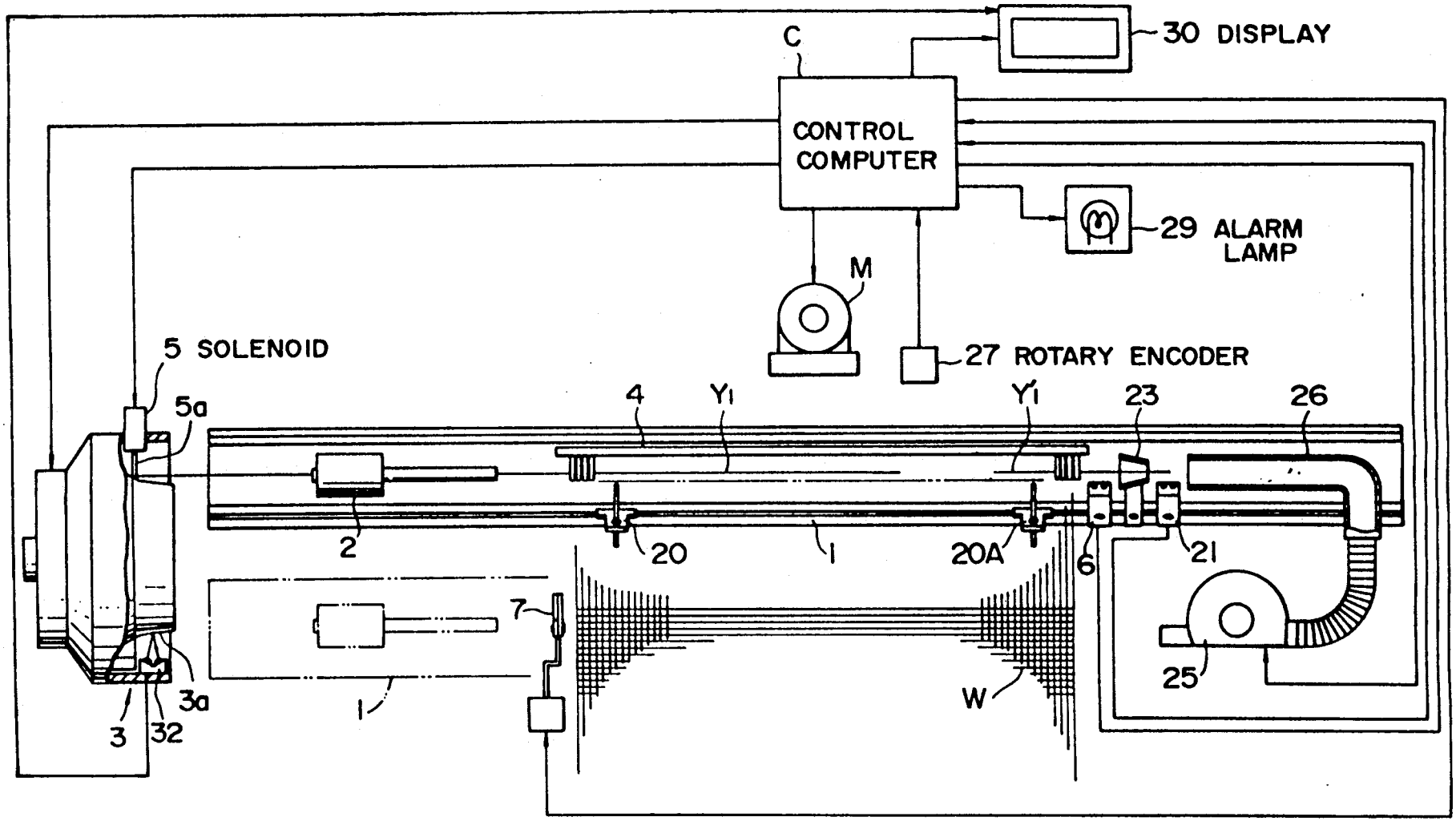
FIG. 11 is a schematic plan view showing another modification of the weft processing apparatus of FIG. 1.
Figure 12:
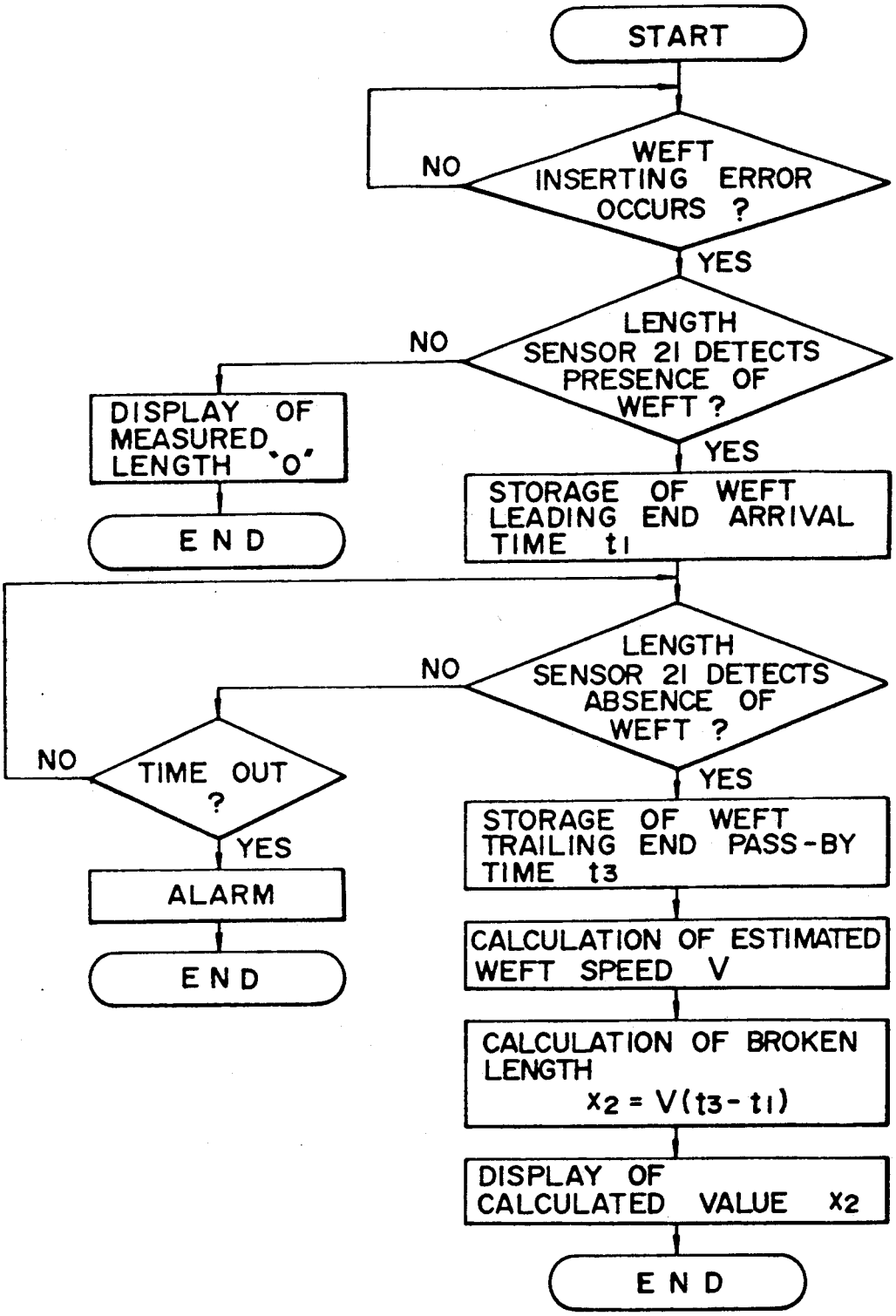
FIG. 12 illustrates in a flow chart a control program for length measurement and display in the weft processing apparatus shown in FIG. 11.

FIG. 11 shows a weft processing apparatus according to still another embodiment of the invention which differs from the preceding embodiments in that the length measuring sensor 22 and the air guide 24 are omitted and that a balloon-type sensor 32 is installed in association with the weft winding surface 3*a*. FIG. 12 shows in a flow chart a control program for measuring and displaying the length of the broken yarn piece $Y'_1$ in the weft processing apparatus shown in FIG. 11. It will be seen from FIG. 12 that the control computer C determines the length $x_2$ of the broken yarn piece $Y'_1$ on the basis of the time $t_1$ at which the leading end of the broken yarn piece $Y'_1$ arrives at the measuring sensor 21, the time $t_3$ at which the trailing end of the broken yarn piece $Y'_1$ passes by the length measuring sensor 21 and an estimated velocity of the broken yarn piece $Y'_1$ obtained from the balloon sensor 32 in accordance with the expression:

$$x_2=V(t_3-t_1)$$

where V represents the estimated velocity which can be determined on the basis of the time interval within which the respective weft turns are released from the weft winding surface 3*a*, which can be detected by the balloon sensor 32. In this manner, the length of the broken yarn piece $Y'_1$ can be measured with great accuracy by estimating the velocity of the broken yarn piece $Y'_1$.

Further, the velocity V of the broken yarn piece $Y'_1$ may be estimated on the basis of the jet pressures of the main weft inserting nozzle 2 and the auxiliary weft inserting nozzles 20, 20A and the type of yarn being used. Alternatively, the velocity of the broken yarn piece $Y'_1$ may be estimated on the basis of the data obtained in the past.

As a further alternative, the velocity V of the broken weft piece $Y_1'$ may be estimated by obtaining the time $t_o$ at which the weft is released from the weft winding surface 3a by the retaining pin 5a, i.e., the time when the leading end of the weft leaves the tip of the nozzle 2. The control computer C determines the velocity V in accordance with the expression:

$$V=L'/(t_1-t_o),$$

where $t_1$ = weft leading end arrival time at detector 6, and

L' = known distance between the tip of the main weft inserting nozzle 2 and the detector 6.

Therefore the length $x_2$ is given by the expression:

$$X_2=L'(t_3-t_2)/(t_1-t_o)$$

where $t_2$ and $t_3$ are the times at which the leading and trailing ends of the broken yarn piece, respectively, pass the sensor 21.

Since sensor 21 provides the times $t_2$ and $t_3$ representing the times at which the leading and trailing ends of the broken yarn piece, respectively pass the sensor 21, this data can be used to determine the length $x_2$ by solving the following equation:

$$x_2=L''(t_3-t_2)/(t_1-t_o)$$

where

L'' = known distance between the tip of the main weft inserting nozzle 2 and the sensor 21 and $t_1$ and $t_o$ are obtained as described for the previous expression.

For both of the above alternative where operation of the retaining pin 5a is used to ascertain time $t_o$, the balloon sensor 32 can be omitted.

Furthermore, the velocity V can be obtained without the balloon sensor 32 or the retaining pin 5a by the expression:

$$V=D/(t_2-t_1)$$

where D represents the distance between the detector 6 and the sensor 21, $t_1$ is the time of arrival of the leading end of a broken weft piece at detector 6, and $t_2$ is the time of arrival of the leading end of the broken weft piece at sensor 21. The length $x_2$ in this case can be obtained by the expression:

$$x_2=V(t_3-t_2)=D(t_3-t_2)/(t_2-t_1)$$

where $t_3$ is the time at which the trailing end of the broken weft yarn piece passes by the sensor 21.

In this manner only the detector 6 and the length measuring sensor 21 are necessary to obtain $x_2$.

Next, a still further embodiment of the present invention will be described by reference to FIGS. 13 to 22. In these figures, the same or like parts as those of the preceding embodiments are denoted by same reference symbols, and repeated description of these parts will be omitted.

The embodiment shown in FIGS. 13 to 22 differs from the one shown in FIG. 1 mainly in that the length measuring sensors are disposed or accommodated within the air guide 24 and that a weft withdrawal device or mechanism is disposed downstream of the warp shed. Owing to the second mentioned difference, the control flow is also modified correspondingly. It should however be mentioned that a weft withdrawal mechanism is also provided at the weft entrance to the warp shed as shown in FIGS. 13 to 22. This weft withdrawal mechanism may be implemented by the same structure as that shown in the perspective view of FIG. 3. Accordingly, detailed illustration of this mechanism is omitted in FIGS. 13 to 22.

Figure 13:
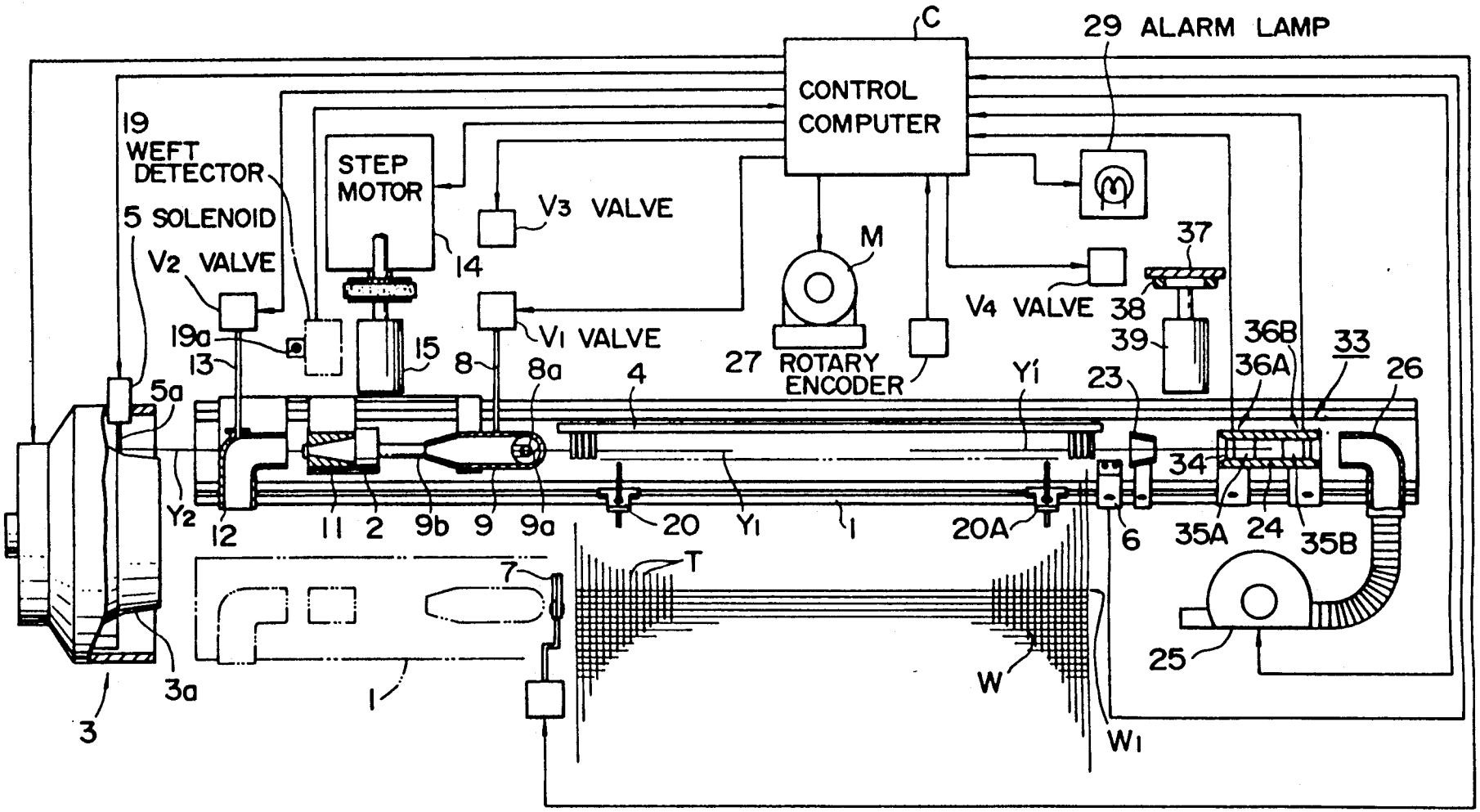
FIG. 13 is a schematic plan view similar to FIG. 1 and shows a portion of a jet loom structure around a slay, which loom is equipped with a weft processing apparatus according to a still further exemplary embodiment of the present invention.
Figure 14:
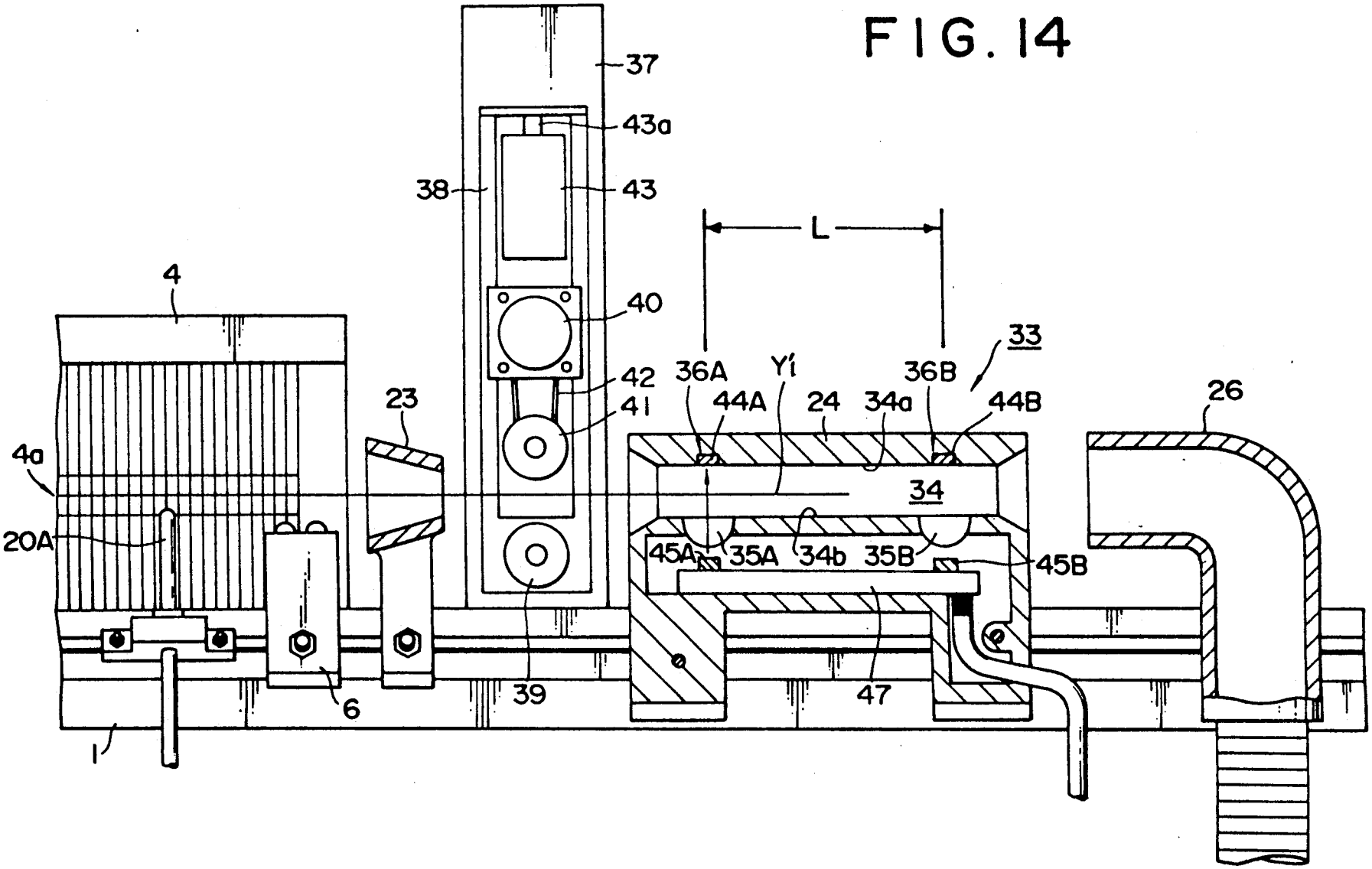
FIG. 14 is an enlarged partial sectional view showing the weft processing apparatus of FIG. 13 in the state in which the leading end of a broken yarn piece has just reached a length measuring sensor disposed at a position close to the downstream side of the warp shed.

Now referring to FIGS. 13 and 14, a weft length measuring device 33 is disposed on the slay 1 at a position further downstream than the weft detector 6. Further, the suction pipe 26 is mounted on the slay 1 at a position beyond the weft length measuring device 33 so as to be integrally movable with the slay 1. A guide passage 34 of rectangular cross-section is formed through the air guide 24, and the air guide 24 is fixedly positioned on the slay 1 in such disposition that the guide passage 34 extends in linear alignment with the weft insertion passage 4a. The inlet portion of the guide passage 34 diverges or flares outwardly, and the auxiliary weft inserting nozzle 20A located farthest downstream is so disposed that the air flow jetted from the nozzle 20A is directed toward the inlet or entrance of the guide passage 34. Thus, a major portion of the air flow jetted from the auxiliary weft inserting nozzle 20A is introduced into the guide passage 34.

Mounted on the top inner wall 34a of the guide passage 34 are a pair of light receiving elements 44A and 44B with a predetermined distance L therebetween. The width of the light receiving area of each of the elements 44A and 44B in the direction transverse to the longitudinal axis of the guide passage 34 is so selected as to correspond to the cross-sectional width and height of the guide passage 34. Further, mounted on the bottom inner wall 34b of the guide passage 34 are a pair of rod lenses 35A and 35B located opposite the light receiving elements 44A and 44B, respectively. Light projecting elements 45A and 45B are disposed immediately beneath the rod lenses 35A and 35B, respectively. Each of the rod lenses 35A and 35B has a semicircular cross-section and a length which is selected to be equal to the cross-sectional width of the guide passage 34. The width of the area across which light is projected from the rod lens 35A, 35B is equal to said cross-sectional width, and the light rays emitted from each of the light projecting elements 45A, 45B are collected in a collimated light beam when viewed in the direction normal to the inner side walls of the guide passage 34, so that the light beam exiting from the rod lens traverses the entire rectangular cross-sectional area of the guide passage 34. In this manner, the light projecting element 45A, the rod lens 35A and the light receiving element 44 cooperate to constitute a first length measuring sensor 36A, while the light projecting element 45B, the rod lens 35B and the light receiving element 44B constitute a second length measuring sensor 36B.

The top surfaces of the rod lenses 35A and 35B are flush with the bottom wall interior surface 34b of the guide passage 34, while the light receiving surfaces of the light receiving elements 44A and 44B are flush with the top wall interior surface 34a of the guide passage 34.

A reference numeral 47 denotes a substrate which incorporates circuits connected to the light projecting elements 45A and 45B, the circuits on the substrate 47 being connected to the control computer C as well.

A base plate 37 is mounted on the slay 1 in an upstanding disposition at a position adjacent the downstream end of an inserted weft to the rear of the slay 1 when the latter is positioned at the most retracted position. A driving roller 41 is supported rotatably in a cantilever-like manner immediately beneath a step motor 40, with the step motor 40 and the driving motor 41 operatively connected to each other through the medium of a belt 42. An air cylinder 43 is installed in a vertical orientation on the base plate 37 at a position immediately above the step motor 40. The air cylinder 43 includes a piston rod 43*a* having an end on which a mounting frame or plate 38 is fixedly supported. Further, a driven roller 39 is rotatably supported in a cantilever-like fashion on the mounting plate 38 at a lower portion on the front surface thereof. The driven roller 39 can be pressed against the driving roller 41 as the mounting plate 38 is moved upwardly, accompanying the extension stroke of the piston rod 43*a*, the gripping region of these rollers 39 and 41 being located on an extension of the longitudinal axis of the weft insertion passage 4*a* above the slay 1 when the latter is at the most retracted position thereof.

In the case of the embodiment shown in FIG. 13 an electromagnetic or solenoid valve $V_4$ is also provided. The control computer C performs the control of the electromagnetic valves $V_1$, $V_2$, $V_3$ and $V_4$, the blower 25 and the step motors 14 and 40 responsive to the detection signals derived from the outputs of the length measuring sensors 36A and 36B.

Figure 21A:
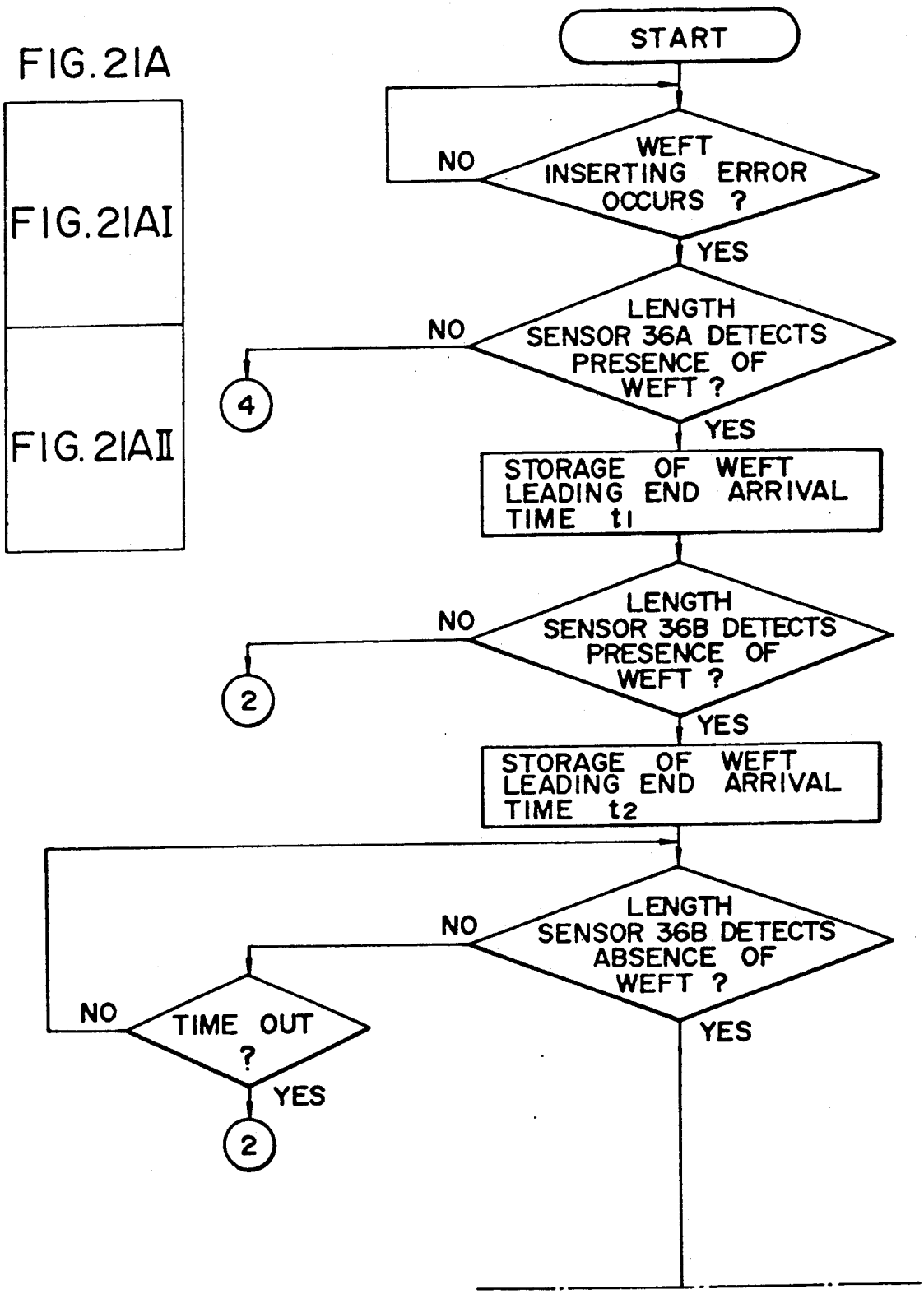
FIGS. 21AI, 21AII, 21BI, 21BII, 21CI, 21CII and 21D are flow charts illustrating weft processing programs executed in the weft processing apparatus shown in FIG. 13.
Figure 21B:
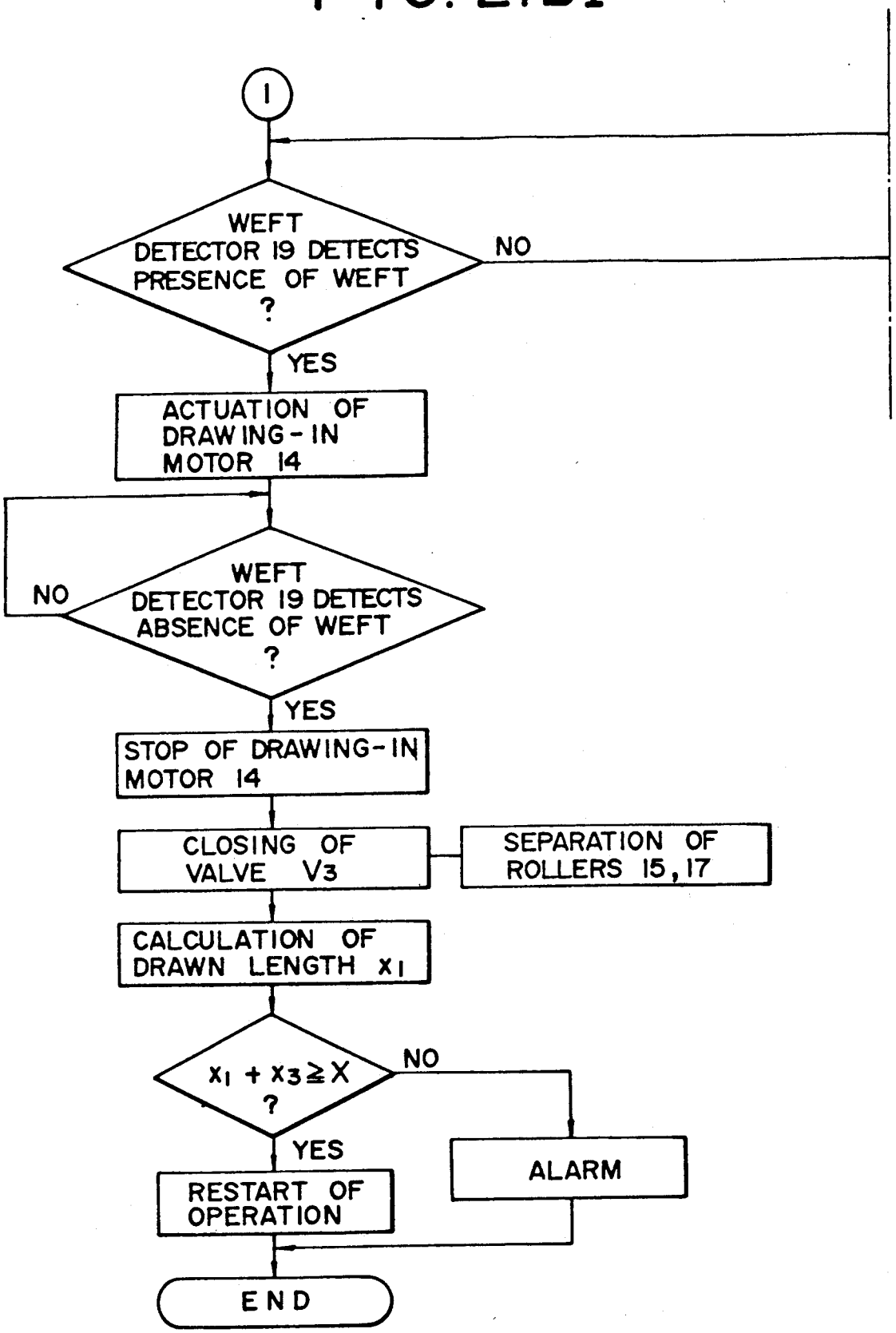
Figure 21C:
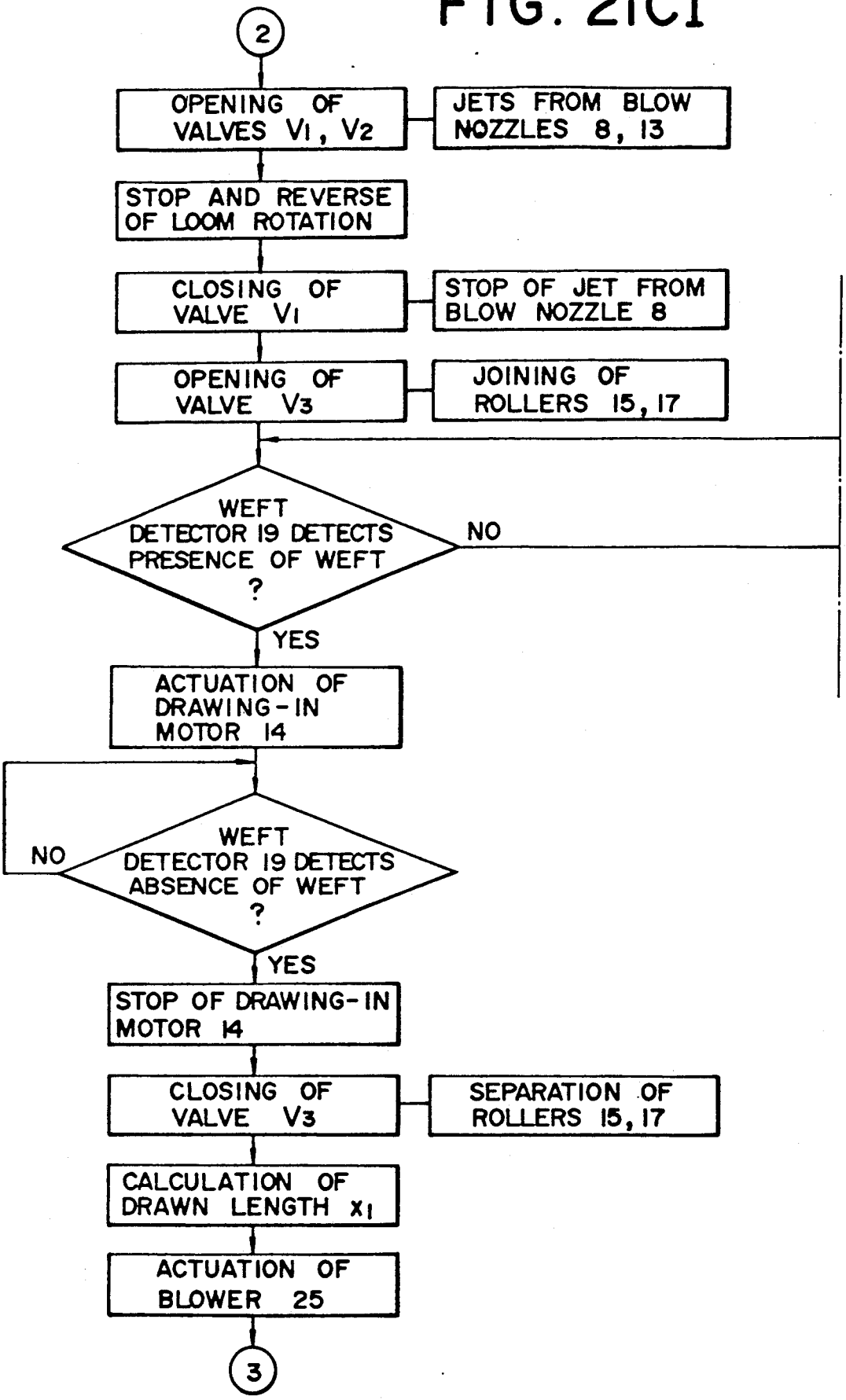
Figure 21D:
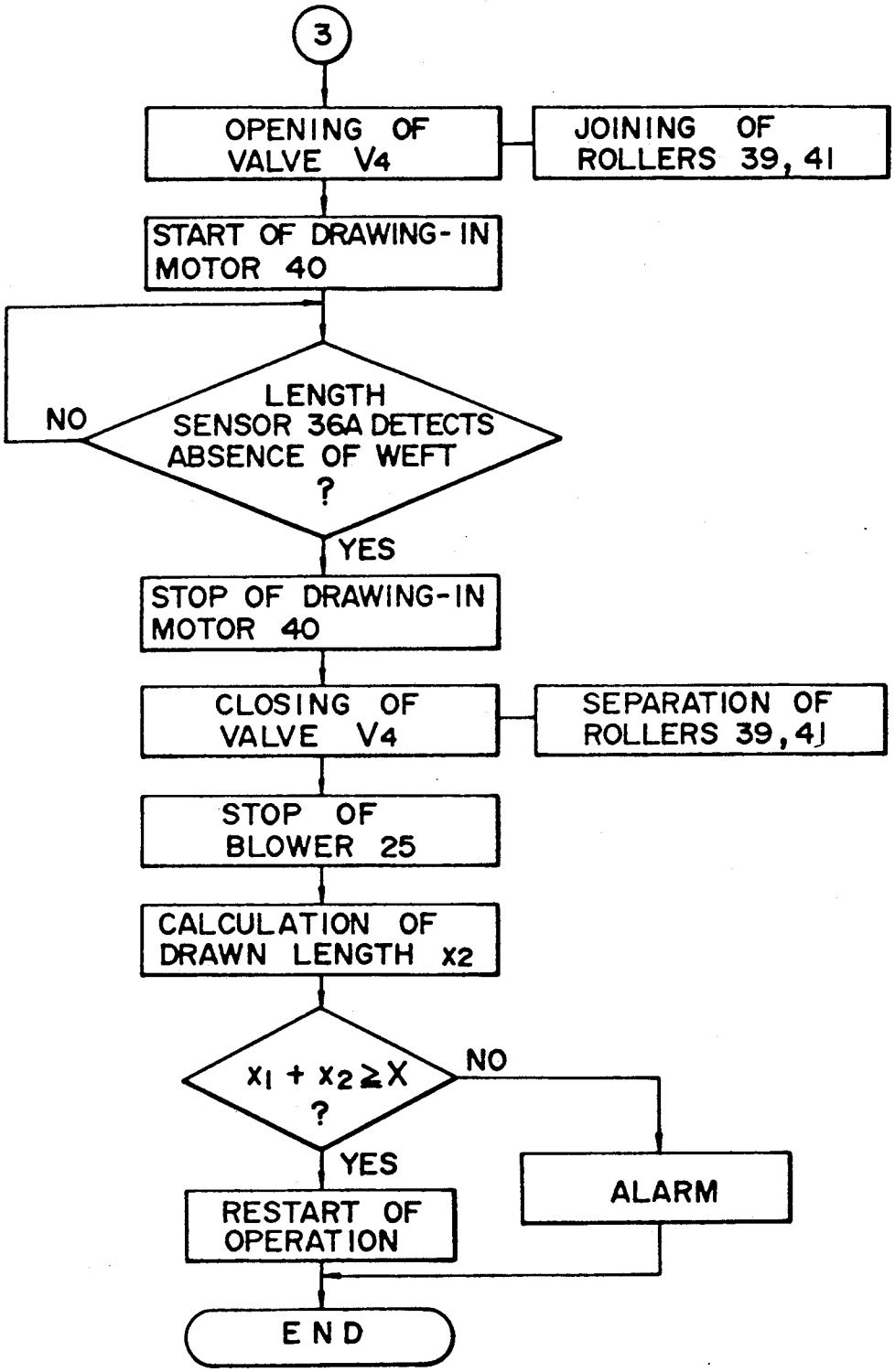

Upon occurrence of a weft insertion error or failure, the control computer C executes a weft processing program illustrated in the form of flow charts in FIGS. 21AI to 21D. Referring to these figures, upon occurrence of failure in the insertion of a weft such that the picked weft does not reach the position of the weft detector 6, the loom control computer C responds to the weft insertion failure detection signal outputted from the weft detector 6 to thereby stop the operations of the electromagnetic cutter 7 and the loom driving motor M and at the same time command the opening of the electromagnetic valves $V_1$ and $V_2$, whereby pressurized air is supplied to the blow nozzles 8 and 13, which in turn results in a weft insertion preventing air flow between the blow nozzle 8 and the weft removal duct 9, the air flow traversing the jet region defined immediately in front of the weft inserting main nozzle 2, while a suction air flow is produced at the inlet side of the suction pipe 12.

These air flows continue to be produced accompanied by the inoperative state of the electromagnetic cutter 7 until the slay 1 has been stopped at the position indicated by the phantom line in FIG. 13. Consequently, the defective weft $Y_1$ is beaten to the cloth fell $W_1$ under the influence of the weft inserting main nozzle 2, while a weft portion $Y_2$ following the defective weft $Y_1$ is withdrawn from the weft length measuring and storing apparatus 3 by the weft insertion preventing air flow jetted from the blow nozzle 8 during rotation of the loom under inertia. The succeeding weft $Y_2$ is thus introduced forcibly into the weft removal duct 9 through the inlet 9*a* thereof. The weft $Y_2$ is then caused to move into the suction pipe 12 from the exit 9*b* of the suction duct 9 through the air guide 11 to be subsequently blown out toward the dust box mentioned above under action of the jet from the blow nozzle 13. As a consequence, the portion of the weft $Y_2$ located between the weft removal duct 9 and the suction pipe 12 is subjected to a tension of corresponding magnitude.

When the weft $Y_1$ is broken, the broken yarn piece $Y'_1$ is detected by the length measuring sensor 36A. In that case, the control computer C detects breakage of the weft $Y_1$ on the basis of the detection signals outputted from both the length measuring sensors 36A and 36B before the weft insertion preventing operation can be performed within the period from the weft insertion failure detection to stoppage of the loom.

Referring to FIGS. 13 and 14, when the broken piece $Y'_1$ of the yarn $Y_1$ remains within the warp shed without being blown off toward the suction pipe 26, the weft presence detection signal from the length measuring sensor 36A continues to be inputted to the control computer C. When the period during which the weft presence signal is being inputted exceeds a predetermined duration, the control computer commands the processing operation of the weft withdrawal apparatus which is composed of the step motor 14, the air cylinder 16 and the pair of rollers 15 and 17 and which is installed at the weft entrance side.

Figure 15:
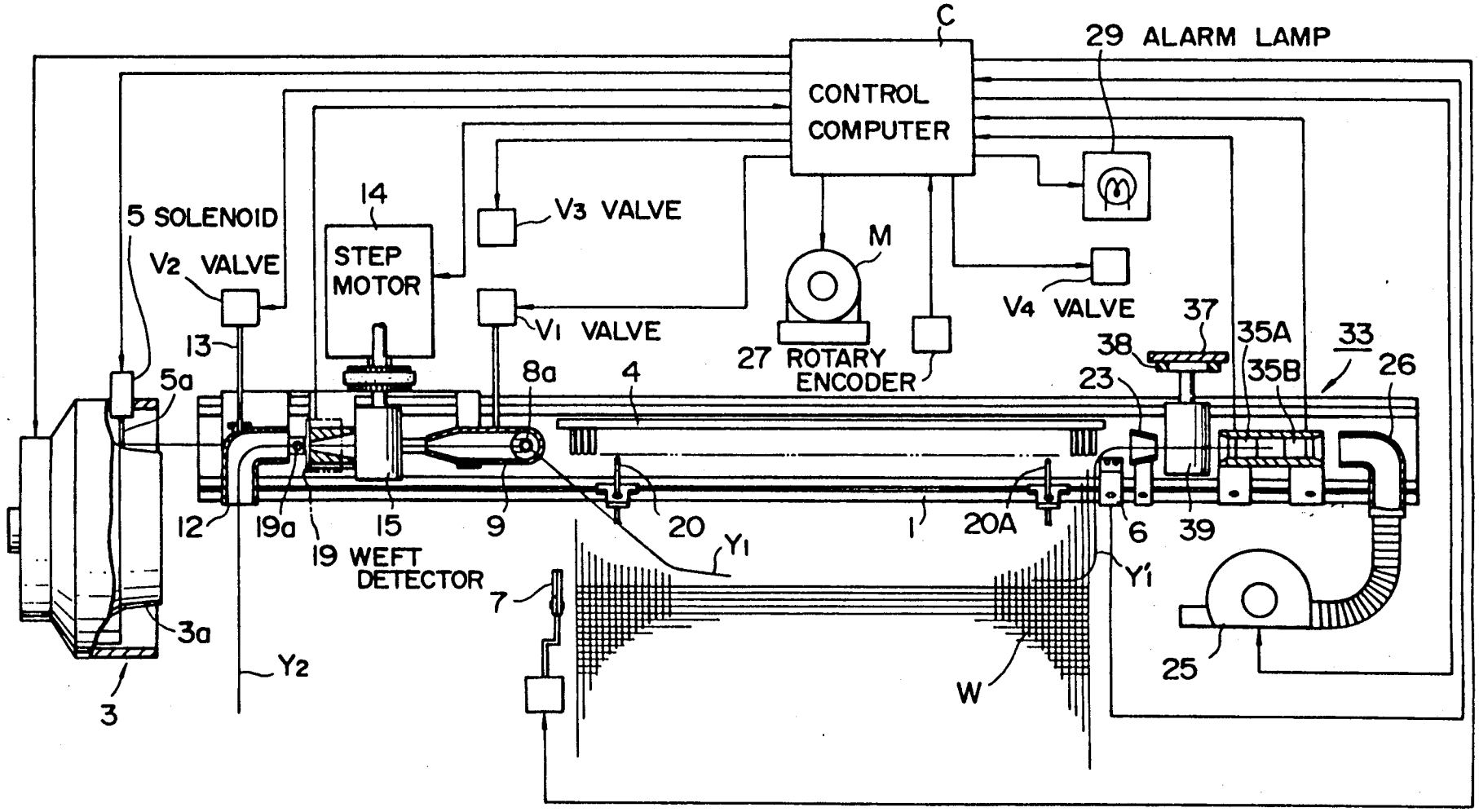
FIG. 15 is a schematic plan view showing the weft processing apparatus of FIG. 13 in the state in which a weft withdrawal action is performed on the weft entrance side of the warp.

After the stoppage of the loom, the loom control computer C commands the rotation of the loom in the reverse direction for a predetermined angular distance corresponding to the detection signal supplied from the rotary encoder 27, whereby the slay 1 is moved to the most retracted position shown in FIG. 15. As a result, the warps T are set to the opened state forming the inter-warp opening or shed, whereby the defective weft $Y_1$ is released from between the upper and lower layers of the warps T. At the same time, the succeeding weft portion $Y_2$ located between the weft removal duct 9 and the air guide 11 is disposed within a grip region defined between the driving roller 15 and the driven roller 17 (refer to FIG. 3), while another portion of the succeeding weft $Y_2$ located between the air guide 11 and the suction pipe 12 is disposed within the region adapted to be swept by the detecting arm 19*a*. After the reverse rotation of the loom, the electromagnetic valve $V_1$ is closed, whereby the weft insertion preventing air flow disappears. In this state, the control computer C commands the opening of the electromagnetic valve $V_3$ to thereby cause the driven roller 17 to bear against the driving roller 15 under pressure.

The operations of the associated members accompanying the downward displacement of the driven roller 17 have been previously described in conjunction with the embodiment shown in FIG. 1. Accordingly, repeated description in this respect will be unnecessary.

Further, operation of the weft processing apparatus taking place during the presence of the succeeding weft $Y_2$ has also been described in conjunction with the embodiment shown in FIG. 1, insofar as the weft withdrawal device installed at the weft upstream location is concerned. Accordingly, repeated description is omitted.

Upon completion of the processing operation of the weft withdrawal device mechanism installed at the weft upstream entrance, the control computer C commands the processing operation of the weft withdrawal device which is constituted by the step motor 40, the air cylinder 43, and the pair of rollers 39 and 41. More specifically, the control computer C commands the opening of the electromagnetic valve $V_4$, whereby the piston rod 43*a* of the air cylinder 43 is caused to extend upwardly. As a result, the driven roller 39 is brought into contact with the driving roller 41 under pressure, whereby the broken yarn piece $Y'_1$ passing through the gripping region is held between the pair of rollers 39 and 41.

After the broken yarn piece $Y'_1$ has been gripped by the pair of rollers 39 and 41, the control computer C commands actuation of the step motor 40, as a result of which the broken yarn piece $Y'_1$ held by these rollers 39, 41 is transferred to the suction pipe 26. Thereafter, upon having passed between the pair of rollers 39 and 41, the broken yarn piece $Y'_1$ is sucked into the suction pipe 26 to be thereby removed.

So long as the broken yarn piece $Y'_1$ withdrawn from the inter-warp opening is gripped between the paired rollers 39 and 41 while being fed to the suction pipe 26 under the action of these rollers, the length measuring sensor 36A continues to output the weft presence detection signal to the control computer C. Upon disappearance of this weft presence detection signal, the control computer C commands the stoppage of the step motor 40 and at the same time issues commands for closing the electromagnetic valve $V_4$ and stopping the operation of the blower 25, respectively. Consequently, the rollers 39 and 41 are separated from each other, while the suction pipe 26 stops the sucking action.

Figure 16:
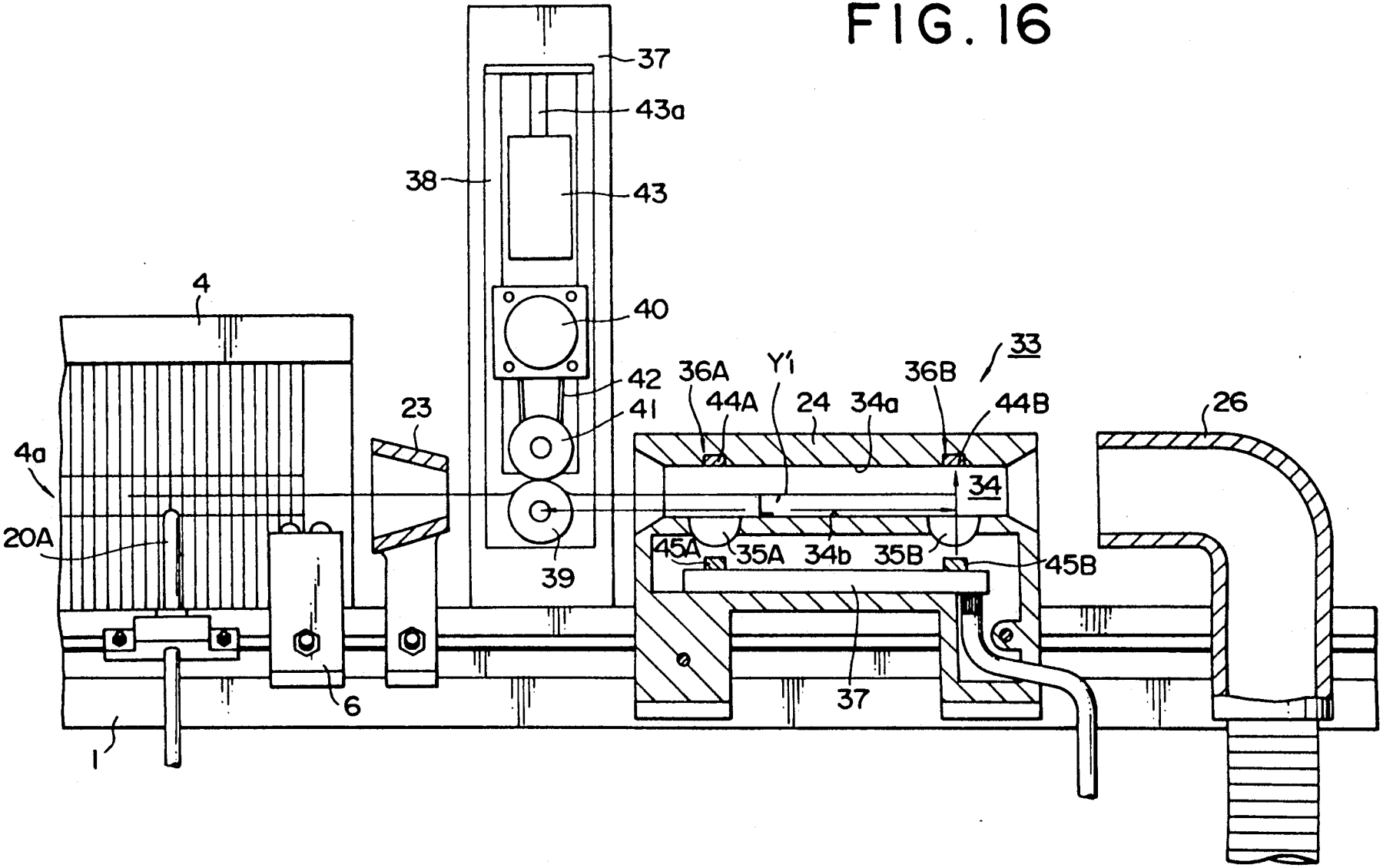
FIG. 16 is a view similar to FIG. 14 showing the state in which a broken yarn piece is gripped and withdrawn at the far side of the shed.
Figure 17:
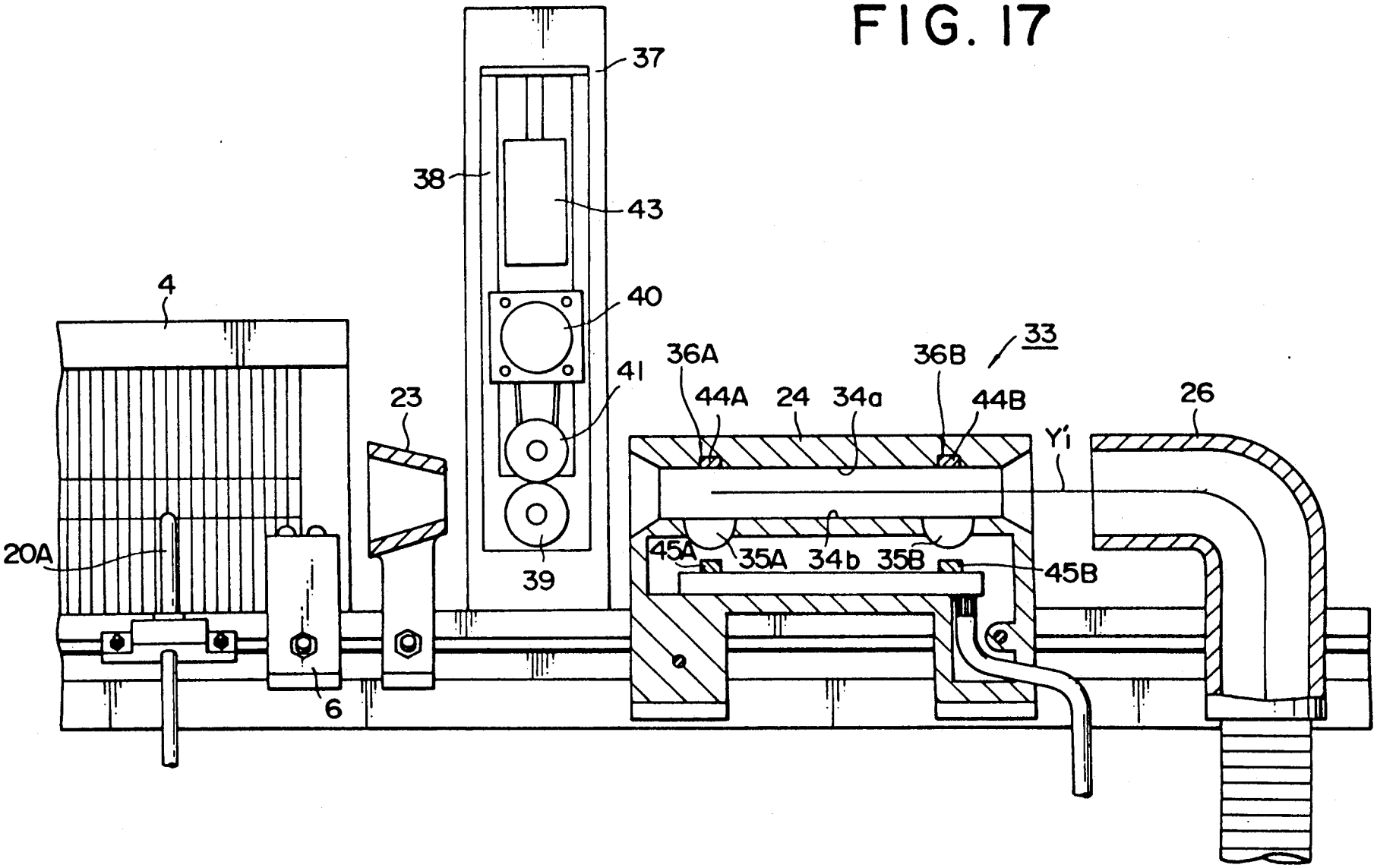
FIG. 17 is a view similar to FIG. 14 showing the state in which the broken yarn piece has just passed through the gripping region of the pair of rollers.

The control computer C arithmetically determines the sum of the length L' shown in FIG. 16, and a withdrawn length x' determined by the withdrawal process for the broken yarn piece $Y'_1$ illustrated in FIG. 16. The value of x' is determined by the number of actuation pulses supplied to the step motor 40 over the period during which a weft presence detection signal has been inputted to the control computer C from the length measuring sensor 36A after the start of operation of the step motor 40. The sum $(x'+L')$ thus obtained represents the total length $x_2$ of the broken yarn piece $Y'_1$.

The control computer then calculates the sum of the withdrawn length $x_1$ and the length $x_2$ of the broken yarn piece $Y'_1$ as in the case of the embodiment shown in FIG. 1. When the sum $(x_1+x_2)$ is equal to or greater than a value corresponding to a preset weft insertion length X, the control computer C commands the restart of operation. On the other hand, in the case of $x_1+x_2<X$, the computer commands generation of an alarm by the alarm lamp 29.

Figure 18:
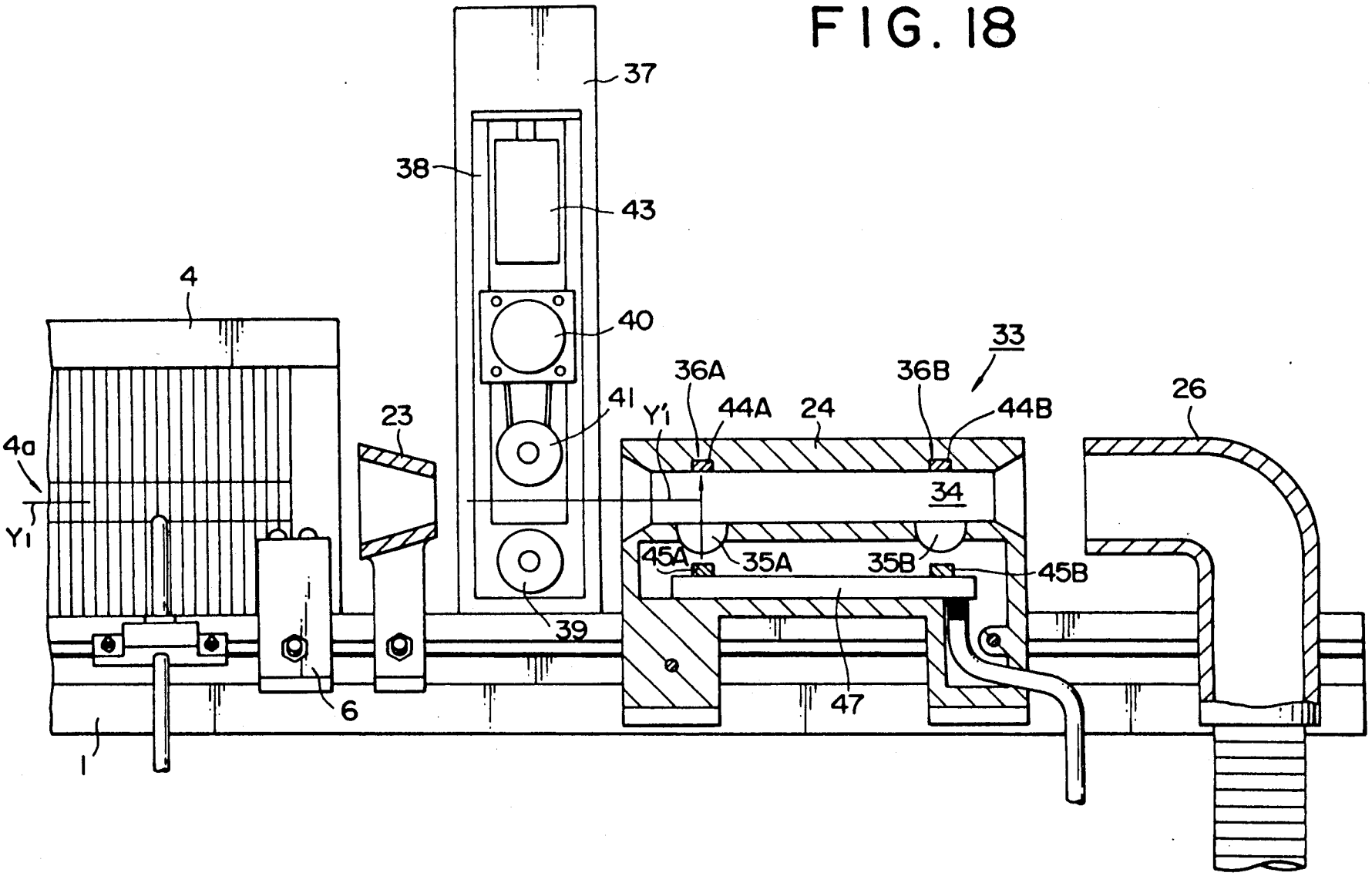
FIG. 18 is a view similar to FIG. 14 showing the state in which the leading end of the broken yarn piece which is blown off is about to reach the length measuring sensor located close to the downstream side of the warp shed.
Figure 19:
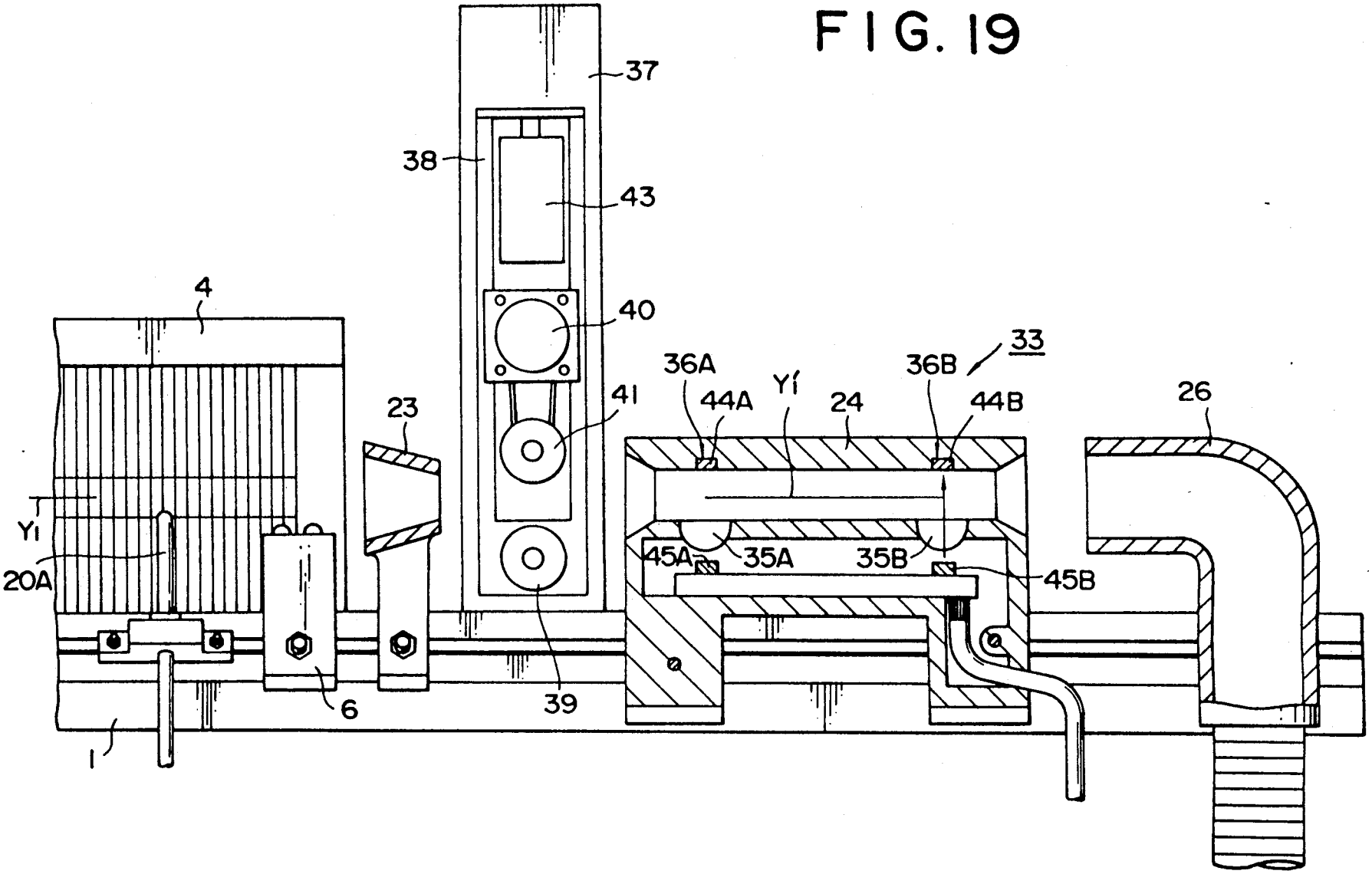
FIG. 19 is a view similar to FIG. 14 showing the state in which the leading end of the blown-off broken yarn piece is about to reach a second length measuring sensor located farther downstream than the first length measuring sensor.
Figure 20:
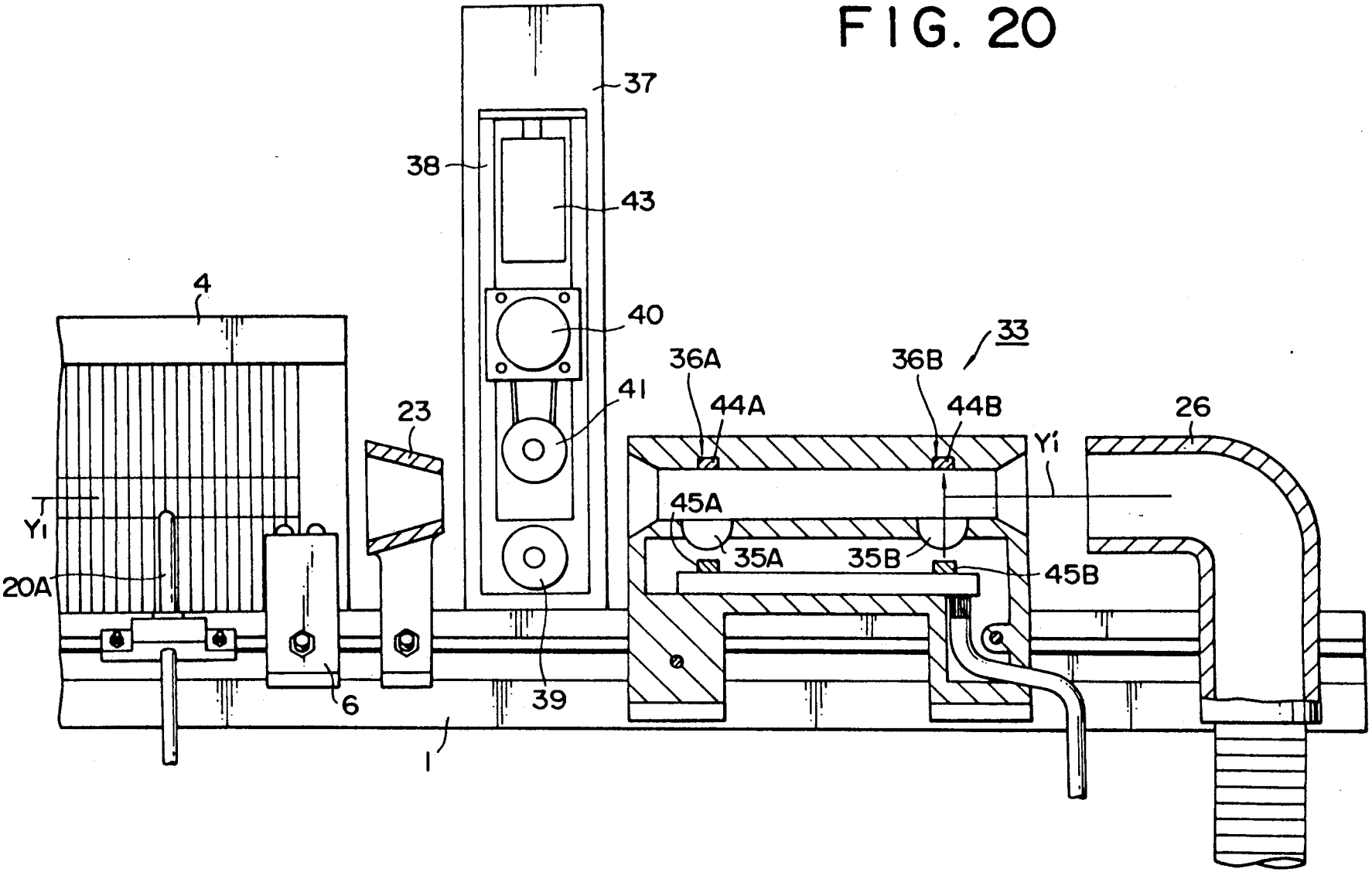
FIG. 20 is a view similar to FIG. 14 showing the state in which the trailing end of the broken yarn piece of the defective weft is passing by the second length measuring sensor.

Referring to FIGS. 18 to 20, when a portion $Y'_1$ of the defective weft $Y_1$ is broken to be blown toward the suction pipe 26, the control computer C commands the processing operation of the weft withdrawal mechanism installed at the weft upstream entrance as described previously. In this connection, it should be again added that in precedence to this processing, the control computer C fetches and stores therein the detection times at which the leading end and the trailing end of the broken yarn piece $Y'_1$ are detected on the basis of the angular information obtained from the rotary encoder 27 for detecting the rotational angle of the loom frame.

The control computer C first stores the weft leading end arrival time $t_1$ of the broken yarn piece $Y'_1$ at the detection region of the length measuring sensor 36A, as shown in FIG. 18, and then stores the weft leading end arrival time $t_2$ at which the leading end of the broken yarn piece $Y'_1$ reaches the detection region of the length measuring sensor 36B as illustrated in FIG. 19. When the trailing end of the broken yarn piece $Y'_1$ has just passed by the detection region of the length measuring sensor 36B, the control computer C stores the weft trailing end pass-by time $t_3$ (See FIG. 20). Subsequently, the control computer C performs an arithmetic operation on the basis of the times $t_1$, $t_2$ and the pass-by time $t_3$ as stored, and the known distance L mentioned hereinbefore with reference to FIG. 14 in accordance with the following expression:

$$x_3=L(t_3-t_2)/(t_2-t_1)$$

where the term $L/(t_2-t_1)$ represents the velocity of the broken yarn piece $Y'_1$, and $(t_3-t_2)$ represents the time taken for the yarn piece $Y'_1$ to traverse the detection zone of the length measuring sensor 36B. Thus, the length of the broken yarn piece $Y'_1$ is given by $x_3$.

Subsequently, the control computer C arithmetically determines the sum of the withdrawn length $x_1$ and the length $x_3$ of the broken yarn piece $Y'_1$. When the sum $(x_1+x_3)$ is equal to or greater than the value X corresponding to the present weft insertion length or pick, the control computer C commands the restart of operation. On the other hand, when $x_1+x_3<X$, the alarm lamp 29 is triggered to generate the alarm. Thus, even when the yarn piece broken or cut from the defective yarn $Y_1$ is blown off and does not remain within the warp shed, it is possible to know whether or not all or some of the defective weft $Y_1$ remains within the warp shed, whereby the possibility that the loom might be restarted when a portion of the defective weft remains within the warp shed can be eliminated.

Figure 22:
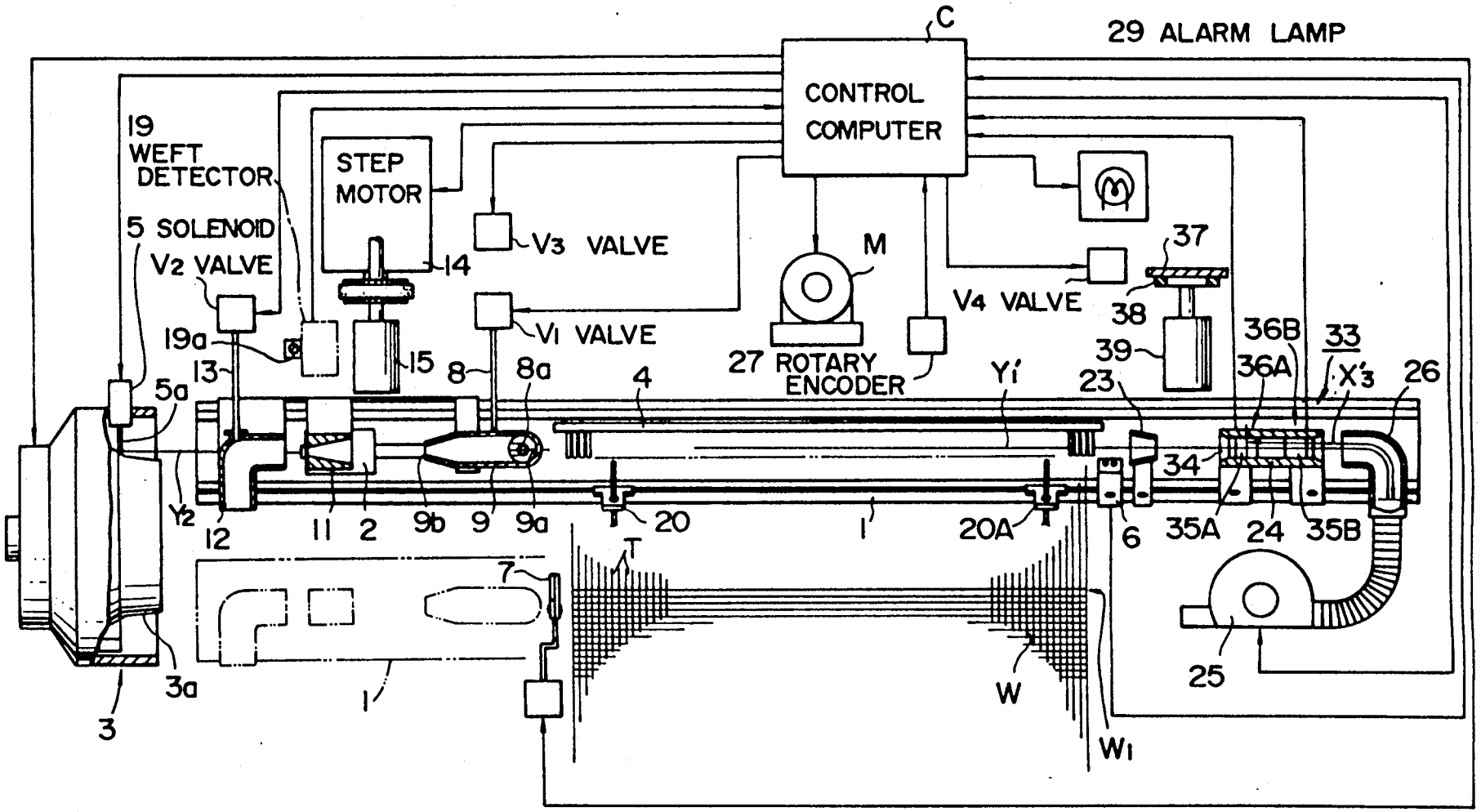
FIG. 22 is a schematic plan view for illustrating another type of weft breakage that might occur in the weft processing apparatus shown in FIG. 13.

Referring to FIG. 22, there may arise a situation in which the weft breakage takes place immediately downstream of the jet orifice of the weft inserting main nozzle 2, resulting in that a portion of the broken yarn piece $Y'_1$ remains in the warp shed with the leading end thereof reaching the suction pipe 26. In that case, because the yarn piece does not travel completely past sensor 36B, the travel time past a fixed point cannot be measured. However, when a period $(t_c-t_1)$ between the time $t_1$ at which the leading end of the broken yarn piece $Y'_1$ passed the length measuring sensor 36A and the warp closing time $t_c$ is assumed to be the weft travelling time, the length $x'_3$ of the weft that has travelled beyond the length measuring sensor 36B can be determined in accordance with the following expression:

$$x'_3=(t_c-t_1)L/(t_2-t_1)$$

where $t_2$ is the time when the leading end of the yarn piece reached the sensor 36B.

Parenthetically, it should be mentioned that the warp closing time $t_c$ varies depending upon the types of woven cloth. Accordingly, it is necessary to set the warp closing time in conformance with the type of cloth being woven.

The embodiment shown in FIG. 13 can be modified similarly to the embodiment described hereinbefore by reference to FIG. 11. However, since the length measuring sensors 36A and 36B are incorporated in the air guide 24 in the case of the embodiment of FIG. 13, the air guide cannot be removed.

The weft detectors 36A and 36B for measuring the length of the broken yarn piece $Y'_1$ are each implemented as a light transmission type photoelectric sensor, wherein each of the collected and collimated light beams produced by the rod lenses 35A and 35B, respectively, sweeps the entire associated rectangular cross-sectional area of the guide passage 34 providing each a curtain that is traversed by a broken yarn piece $Y'_1$ regardless of which part of the guide passage the broken yarn piece passes through. Consequently, the decrease in the quantity of light impinging on the light receiving element 44A, 44B which is brought about by the broken yarn piece $Y'_1$ passing through the light curtain remains constant independent of the location where the yarn piece $Y'_1$ passes through, which in turn means that the detection coverage area can be much wider as compared with that of the light reflection type photoelectric sensor. Such broad detection region can successfully cope with random or irregular running paths of the broken yarn piece $Y'_1$ within the guide passage 34, which is extremely advantageous for realizing a high detection accuracy as required in the length measurement for detecting the presence or absence of thin and fine objects such as the leading end and the trailing end of the broken yarn piece among others.

Further, by virtue of the rectangular cross-section of the guide passage 34, revolution or swirling of the air flow through the guide passage 34 is suppressed to a minimum, whereby vibration of the broken yarn piece $Y'_1$ otherwise brought about is suppressed correspondingly. Such vibration-proof feature contributes to enhancing the detection accuracy.

It can be readily understood that the signal resulting from the photoelectric conversion is protected against pulsation due to vibration of the yarn. Thus, discrimination against the passage of fly waste which gives rise to pulse-like signal generation is realized with high reliability.

Additionally, the top wall 34*a*, the bottom wall 34*b* and both the side walls which cooperate to define the guide passage 34 are formed flat or smooth, which ensures an improved uniformity of the air flow within the guide passage 34. Such uniformity of the air flow is required for substantially constant running or flying speed, i.e., velocity, of the broken yarn piece $Y'_1$, because the length measurement thereof is performed on the presumption that the flying or running speed is constant. For these reasons, the rectangular cross-sectional configuration of the guide passage 34 as well as the flat wall surfaces defining the passage contribute to significant improvement of the accuracy required in the length measurement.

The embodiment shown in FIG. 13 is susceptible to numerous modifications and variations. For example, the guide passage 34 may be formed of a transparent material such as acryl resin or the like. In that case, the rod lenses 35A, 35B and light receiving elements may be disposed at the exterior surfaces of the transparent walls, whereby the flatness of the enclosing walls of the guide passage can be enhanced to a maximum, advantageously to the realization of high uniformity of the air flow.

It should be added that a rod lens of a circular cross-section can be used as well. Further, a condenser lens may be disposed immediately before the light receiving part. When the rod lens of a circular cross-section is used, the collected light rays impinge without being collimated. Although the light receiving elements 44A and 44B are mounted on the top wall 34*a* of the guide passage 34 with the rod lenses 35A and 35B disposed on the bottom wall 34*b* in the case of the embodiment shown in FIG. 13, it should be appreciated that they may be installed on the side walls of the guide passage with similar effects. Furthermore, the light projecting element may be replaced by an optical fiber type light projecting device.

While the embodiment described with reference to FIGS. 13 to 22 has a detector 6 and two length measuring sensors 36A and 36B, similar in function to the elements 6, 21 and 22 in the embodiment of FIG. 1, one of the sensors such as sensor 36B can be omitted similar to the omission of sensor 22 in the embodiment of FIG. 1. That is, passage of the broken weft yarn piece $Y'_1$ past detector 6 and sensor 36A can be arranged to provide, respectively, the times $t_1$ and $t_2$ for determining the velocity of the weft yarn piece based on knowledge of the distance separating the sensor 36A from the detector 6. Assuming such distance to be represented by D', the velocity V is given by the expression:

$$V = D'/(t_2 - t_1).$$

If it is necessary to determine the length $x'_3$ of the portion of the broken weft yarn piece that has travelled beyond sensor 36A when the warp shed closes at time $t_c$, it can be obtained from the expression:

$$x'_3 = V(t_c - t_2) = D'(t_c - t_2)/(t_2 - t_1).$$

In the case of warp shed closure occurring before the broken weft yarn piece has left the shed, a portion will remain trapped therein to be withdrawn by the pinch rollers 39 and 41. Knowing the number of steps taken by the step motor 40 until the trailing end of the broken weft yarn piece passes sensor 36A, it is possible to calculate the length $x'_2$ of that portion of the broken weft yarn piece that was upstream of the rollers 39, 41 at the time when motor 40 was initially energized. This is the length withdrawn by the rollers 39, 41. The length $x'_2$ is calculated by knowing the circumference of the roller 41 and the total angular rotation thereof. The motor 40 is deenergized when the trailing end of the broken weft yarn piece passes the sensor 35A and sensor 35A provides a weft yarn absence signal. Included in $x'_2$ is the known distance between the rollers 39, 41 and the sensor 36A.

It is felt that the present invention will be understood from the foregoing description and it will be apparent that various changes may be made in the form, construction and arrangement thereof without departing from the spirit and scope of the invention or sacrificing all of its material advantages, the forms hereinbefore described being merely preferred or exemplary embodiments thereof.

I claim:

1. A weft processing apparatus for a jet loom, comprising weft length measuring means including at least one sensor disposed substantially at a termination point for reception of a weft jetted from a weft inserting main nozzle into a weft insertion passage and thereby inserted into a warp shed, wherein said weft length measuring means includes means for measuring the length of a broken weft yarn piece separated from the weft inserted.

2. A weft processing apparatus according to claim 1, further comprising:

control means connected to said weft length measuring means;

first weft detecting means disposed at a predetermined position in the vicinity of said weft length measuring means and spaced from said warp shed and being adapted to supply a weft insertion failure detection signal to said control means unless the weft inserted arrives at said predetermined position, thereby commanding stoppage of a driving motor for said jet loom through said control means;

said weft length measuring means including a pair of photoelectric length measuring sensors disposed with a predetermined distance (L) therebetween at respective positions each at a greater distance from said warp shed than said first weft detecting means; and said control means being previously loaded with the value of said predetermined distance (L) and being adapted to obtain and store therein, when said broken weft piece passes by said pair of length measuring sensors, a weft leading end arrival time ($t_1$) at which a leading end of said broken weft piece reaches a detection region of one of said pair of length measuring sensors, a weft leading end arrival time ($t_2$) at which the leading end of said broken weft piece reaches a detection region of the other length measuring sensor, and a weft trailing end pass-by time ($t_3$) at which a trailing end of said broken weft piece passes by said detection region of said other length measuring sensor, thereby performing on the basis of said arrival times ($t_1$, $t_2$), said pass-by time ($t_3$) and said predetermined distance (L) an arithmetic operation in accordance with the following expression:

$$x_2 = L(t_3 - t_2)/(t_2 - t_1)$$

wherein $L/(t_2 - t_1)$ represents the velocity of said broken weft piece, $(t_3 - t_2)$ represents the time taken for said broken weft piece to pass by said other length measuring sensor, and ($x_2$) represents the length of said broken weft piece.

3. A weft processing apparatus according to claim 2, wherein said weft length measuring means includes:

an air duct having a passage of rectangular cross-section for guiding the weft;

a pair of sensor arrays each including a light projecting element and a light receiving element which cooperate to constitute each of said length measuring sensors and which are disposed in opposition to each other within said passage of said air duct on a first pair of opposite inner surfaces thereof, respectively; and lens means disposed between said light projecting and receiving elements of each sensor array at a position closer to said light projecting element for focusing light rays emitted from said light projecting element onto the associated light receiving element in such a pattern that substantially the entire area of said rectangular cross-section is traversed by said focused light rays.

4. A weft processing apparatus according to claim 2, further comprising alarm means connected to said control means, wherein unless said other length measuring sensor detects the presence of the weft piece while said one length measuring sensor detects the presence of the weft piece, said control means outputs to said alarm means an alarm signal indicating that the broken weft piece remains within said warp shed.

5. A weft processing apparatus according to claim 2, further comprising display means connected to said control means for displaying said measured length ($x_2$) of said broken weft piece.

6. A weft processing apparatus according to claim 2, further comprising:

second weft detecting means disposed at the entrance side of said jet loom from which the weft is inserted into said weft insertion passage, said second weft detecting means being connected to said control means and adapted to detect the presence or absence of a defective weft within said warp shed at said entrance side; and weft withdrawal means disposed at said entrance side of the jet loom and including a step motor connected to said control means and paired driving and driven rollers;

wherein said control means supplies actuation pulses to said step motor of said weft withdrawal means over a period during which a weft presence detection signal is being inputted to said control means, said control means determining arithmetically on the basis of the number of said pulses a length ($x_1$) by which the defective weft has been withdrawn from said warp shed and then determining arithmetically a sum of the withdrawn length ($x_1$) of said defective weft and said length ($x_2$) of said broken weft piece, thereby commanding restart of the operation of said jet loom when said sum is equal to or greater than a value corresponding to a preset weft insertion length.

7. A weft processing apparatus according to claim 6, further comprising:

an air flow converging tube fixedly mounted on a slay of said jet loom at a position between said first weft detecting means and said one of said pair of length measuring sensor means;

an air guide fixedly mounted on said slay at a position between said pair of length measuring sensor means;

said air converging tube and said air guide having respective center axes aligned with an extension of said weft insertion passage;

said pair of length measuring sensor means having respective detection regions defined on and along said extension of said weft insertion passage; and a suction pipe disposed at a position located beyond said other of said pair of length measuring sensor means, and a blower connected to said suction pipe.

8. A weft processing apparatus according to claim 6, further comprising a command means connected to said control means for commanding operations of said second weft detecting means and said weft withdrawal means.

9. A weft processing apparatus according to claim 1, further comprising:

control means connected to said weft length measuring means and having a winding type weft storage and measuring device of said jet loom connected thereto;

first weft detecting means disposed at a predetermined position in the vicinity of said weft length measuring means and spaced from said warp shed and being adapted to supply a weft insertion failure detection signal to said control means unless the weft inserted arrives at said predetermined position, thereby commanding stoppage of a driving motor for said jet loom through said control means;

said weft length measuring means including a length measuring sensor disposed at a greater distance from said warp shed than said first weft detecting means, and a balloon sensor disposed in the vicinity of said winding type weft storing and length measuring device; and said control means being adapted to obtain and store therein, when said broken weft piece passes by said pair of length measuring sensors, a weft leading end arrival time ($t_1$) at which a leading end of said broken weft piece reaches a detection region of said length measuring sensor, and a weft trailing end pass-by time ($t_3$) at which the trailing end of said broken weft piece passes by said detection region of the said length measuring sensor, and arithmetically determine an estimated velocity (V) of said broken weft piece on the basis of information obtained from said balloon sensor, thereby performing on the basis of said arrival time ($t_1$), said pass-by time ($t_3$) and said estimated running speed (V) an arithmetic operation in accordance with the following expression:

$$x_2 = V(t_3 - t_1)$$

to thereby obtain the length ($x_2$) of said broken weft piece.

10. A weft processing apparatus for a jet loom, comprising:

first weft length measuring means disposed at the side of a termination point for reception of a weft jetted from a weft inserting main nozzle for measuring the length of a broken weft yarn piece separated from the weft inserted;

weft withdrawal means for removing a defective weft which has undergone abnormal weft insertion by withdrawing laterally said defective weft through the action of a succeeding weft connected to said defective weft; and second weft length measuring means for measuring the length of said defective weft which has undergone abnormal insertion and has been withdrawn by said weft withdrawal means.

11. A weft processing apparatus according to claim 10, said first and second weft length measuring means including a computer, wherein said weft processing apparatus further comprises:

first weft detecting means disposed at a predetermined position in the vicinity of said first weft length measuring means and spaced from said warp shed and being adapted to supply a weft insertion failure detection signal to said computer unless the weft as inserted arrives at said predetermined position, thereby commanding stoppage of a driving motor for said jet loom through said computer;

wherein said first weft length measuring means includes a pair of photoelectric length measuring sensors disposed with a predetermined distance (L) therebetween at respective positions each at a greater distance from said warp shed than said first weft detecting means;

said computer being previously loaded with said predetermined distance (L) and being adapted to obtain and store therein, when said broken weft piece passes by said pair of length measuring sensors, a weft leading end arrival time ($t_1$) at which a leading end of said broken weft piece reaches a detection region of one of said pair of length measuring sensors, a weft leading end arrival time ($t_2$) at which the leading end of said broken weft piece reaches a detection region of the other length measuring sensor, and a weft trailing end pass-by time ($t_3$) at which the trailing end of said broken weft piece passes by the detection region of said other length measuring sensor, thereby performing on the basis of said arrival times ($t_1$, $t_2$), said pass-by time ($t_3$) and said predetermined distance (L), as stored, an arithmetic operation in accordance with the following expression:

$$x_2 = L(t_3 - t_2)/(t_2 - t_1)$$

wherein $L/(t_2 - t_1)$ represents the velocity of said broken weft piece, $(t_3 - t_2)$ represents the time taken for said broken weft piece to pass by said other length measuring sensor, and ($x_2$) represents the length of said broken weft piece; and said weft processing apparatus further comprises second weft detecting means disposed at the entrance side of the jet loom from which the weft is inserted, for detecting the presence or absence of the weft at said entrance side, said second weft detecting means being connected to said computer; and wherein said weft withdrawal means includes a step motor connected to said computer and a pair of driving and driven rollers;

said computer supplying actuation pulses to said step motor of said weft withdrawal means over a period during which the weft presence detection signal is being inputted to said computer;

said computer determining arithmetically on the basis of the number of said pulses a length ($x_1$) by which the defective weft has been withdrawn from the warp shed and then determining arithmetically a sum of the withdrawn length ($x_1$) of said defective weft and the length ($x_2$) of said broken weft piece, thereby commanding restart of operation of said jet loom when said sum is equal to or greater than a value corresponding to a preset weft insertion length.

12. A weft processing apparatus for a jet loom, comprising:

first weft withdrawal means disposed alongside a termination point for reception of a weft inserted under the action of a jet from a weft inserting main nozzle for removing a broken weft piece separated from an inserted weft by withdrawing said broken weft piece laterally from a warp shed;

first weft length measuring means for measuring the length of the broken weft piece withdrawn by said first weft withdrawal means;

second weft withdrawal means for removing a defective weft which has undergone abnormal weft insertion by withdrawing laterally said defective weft by making use of a succeeding weft connected to said defective weft; and second weft length measuring means for measuring the length of said defective weft which has undergone abnormal insertion and has been withdrawn by said second weft withdrawal means.

13. A weft processing apparatus according to claim 12, further comprising:

control means connected to said first and second weft length measuring means;

first weft detecting means disposed at a predetermined position in the vicinity of said first weft length measuring means and adapted to supply a weft insertion failure detection signal to said control means unless the weft as inserted arrives at said predetermined position, thereby commanding stoppage of a driving motor for said jet loom through said control means;

second weft detecting means disposed at the entrance side of said jet loom from which the weft is inserted and connected to said control means, for detecting the presence or absence of the weft at said entrance side;

each of said first and second weft withdrawal means including a step motor and a pair of driving and driven rollers;

said first weft length measuring means including a pair of photoelectric length measuring sensors disposed with a predetermined distance (L) therebetween;

said control means commanding operation of said second weft withdrawal means in response to the weft presence detection signal outputted from said second weft detecting means when said broken weft piece has not passed by said pair of length measuring sensors;

said control means supplying actuation pulses to said step motor of said second weft withdrawal means over a period during which the weft presence detection signal from said second weft detecting means is being inputted thereto, and arithmetically determining the length ($x_1$) of the weft withdrawn from said warp shed on the basis of the number of said pulses;

said control means commanding operation of said first weft withdrawal means after completion of the operation of said second weft withdrawal means and arithmetically determining a withdrawn length (x') of the broken weft piece on the basis of the number of actuation pulses supplied to said step motor of said first weft withdrawal means over a period during which the weft presence detection signal is being inputted to said control means from said other length measuring sensor following the start of operation of said step motor triggered when said broken weft piece is gripped between said driving and driven rollers of said first weft withdrawal means; and said control means determining arithmetically a sum of said withdrawn length (x') and a length (L') of the weft extending between said driving and driven rollers and said other length measuring sensor and loaded previously into said control means to thereby calculate the length of said broken weft piece in accordance with $$x_2 = X' + L'$$

and commanding restart of operation of said jet loom when the sum ($x_1 + x_2$) is greater than a value corresponding to a preset weft insertion length.

14. A weft processing apparatus according to claim 13, wherein when said broken weft piece passes by said pair of length measuring sensors, said control means comprises a computer for obtaining and storing therein a weft leading end arrival time point ($t_1$) at which a leading end of the broken weft piece reaches a detection region of said one length measuring sensor, a weft leading end arrival time ($t_2$) at which the leading end of said broken weft piece reaches a detection region of said other length measuring sensor, and a weft trailing end pass-by time ($t_3$) at which a trailing end of said broken weft piece passes by the detection region of said other length measuring sensor, thereby performing on the basis of said arrival times ($t_1$ $t_2$), said passby time ($t_3$) and said predetermined distance (L) between said pair of length measuring sensors loaded previously into said control means an arithmetic operation in accordance with the following expression:

$$x_3 = L(t_3 - (t_2)/t_2 - t_1)$$

wherein $L/(t_2 - t_1)$ represents the velocity of said broken weft piece, ($t_3 - t_2$) represents the time taken for said broken weft piece to pass by said other length measuring sensor, and ($x_3$) represents the length of said broken weft piece, wherein said control means commands restart of operation of said jet loom when the sum ($x_1 + x_3$) is equal to or greater than a value corresponding to the present weft insertion length.

15. A weft processing apparatus according to claim 12, wherein said first weft length measuring means includes:

a pair of photoelectric length measuring sensor arrays disposed with a predetermined distance therebetween;

an air duct having a passage of rectangular cross-section for guiding a weft therethrough;

each of said pair of sensor arrays including a light projecting element and a light receiving element which cooperate to constitute each of said length measuring sensors and which are disposed in opposition to each other within said passage of said air duct on a first pair of opposite inner surfaces thereof, respectively;

each of said sensor arrays further including a lens means disposed between said light projecting element and said light receiving element at a position close to said light projecting element for focusing light rays emitted from said light projecting element onto the associated light receiving element in such a pattern that substantially the entire area of said rectangular cross-section is traversed by said focused light rays.

16. A weft processing apparatus according to claim 15, wherein said air duct is formed of transparent walls, and wherein said light receiving part and said lens means are disposed on exteriorsurfaces of said transparent walls to thereby avoid disturbing the flatness of the interior surface of said air duct.

17. A weft processing apparatus according to claim 15, wherein said lens means comprises a rod lens of a substantially semicircular cross-section.

18. Weft processing apparatus for a jet loom which forms a warp shed during loom operation, said warp shed having a weft entrance side and a weft exit side, said apparatus comprising a controller for controlling the operation of said loom, first means including a weft inserting main nozzle disposed at said weft entrance side for inserting a predetermined length of weft yarn into said warp shed, second means disposed at said exit side of said shed for detecting satisfactory and unsatisfactory insertion of said predetermined length of weft yarn into said warp shed and for providing a signal to said controller, and at least one additional means disposed on one side of said shed for providing another signal to said controller in cooperation with said second means for measuring a length of weft yarn recovered from said shed upon detection by said second means of an unsatisfactory weft insertion.

19. Weft processing apparatus according to claim 18, wherein said second means comprises a first sensor for detecting at its location the presence or absence of a weft yarn and providing said first mentioned signal, and said additional means comprises a second sensor disposed at said exit side of said warp shed a predetermined distance from said first sensor farther from said warp shed exit in alignment with said first sensor and said warp shed for providing said second mentioned signal.

20. Weft processing apparatus according to claim 18, wherein said second means comprises a first sensor coupled to said controller for detecting at its location the presence or absence of a weft yarn and providing said first mentioned signal, and said additional means comprises a second sensor disposed at said entrance side of said warp shed and coupled to said controller for providing said second mentioned signal.

21. Weft processing apparatus according to claim 20, wherein said first means comprises a winding type weft metering and storing device for supplying said predetermined length of weft yarn to said main nozzle, and said second sensor comprises a balloon sensor disposed adjacent and in cooperation with said winding type device.

22. Weft processing apparatus according to claim 21, wherein said controller comprises timing means for determining the velocity (V) with which a weft is jetted through said warp shed on the basis of the time ($t_0$) when said predetermined length of weft yarn is released for insertion through said warp shed, the time (t), when the leading end of said predetermined length of warp yarn is detected by said first sensor, and the known distance (L) between said first sensor and the tip of said main nozzle, using the expression:

$$V=L/(t_1-t_0),$$

said balloon sensor providing a signal marking the time $t_0$.

23. Weft processing apparatus according to claim 18, wherein said first means comprises a winding type weft metering and storing device for supplying said predetermined length of weft yarn to said main nozzle, said second means comprises a first sensor coupled to said controller for detecting at its location the presence or absence of a weft yarn and providing said first mentioned signal, and said additional means comprises a retaining pin assembly disposed adjacent said winding type device, said another signal being related to actuation of said retaining pin assembly to release said predetermined length of weft yarn.

24. Weft processing apparatus according to claim 23, wherein said controller comprises timing means for determining the velocity (V) with which a weft is jetted through said warp shed on the basis of the time ($t_0$) when said predetermined length of weft yarn is released for insertion through said warp shed, the time ($t_1$) when the leading end of said predetermined length of warp yarn is detected by said first sensor, and the known distance (L) between said first sensor and the tip of said main nozzle, using the expression:

$$V=L/(t_1-t_0),$$

said time ($t_0$) being obtained by said controller from a signal corresponding to the said actuation of said retaining pin assembly to release said predetermined length of weft yarn.

* * * * *